US008385762B2

(12) United States Patent
Noguchi et al.

(10) Patent No.: US 8,385,762 B2
(45) Date of Patent: Feb. 26, 2013

(54) TRANSFER DEVICE AND IMAGE FORMING APPARATUS

(75) Inventors: Hidetaka Noguchi, Hyogo (JP); Toshiyuki Andoh, Kanagawa (JP); Takashi Hodoshima, Kanagawa (JP); Seiji Hoshino, Kanagawa (JP); Takashi Hashimoto, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 575 days.

(21) Appl. No.: 12/461,905

(22) Filed: Aug. 27, 2009

(65) Prior Publication Data

US 2010/0054781 A1 Mar. 4, 2010

(30) Foreign Application Priority Data

Sep. 1, 2008 (JP) ..... 2008-223877

(51) Int. Cl.
*G03G 15/06* (2006.01)
*G03G 15/00* (2006.01)

(52) U.S. Cl. ..... 399/66; 399/121; 399/167; 399/302; 399/388; 399/396; 271/10.06; 271/270; 271/271; 271/275

(58) Field of Classification Search ..... 399/66, 399/121, 165, 302, 388, 396, 397; 271/270, 271/271, 275
See application file for complete search history.

(56) References Cited

U.S. PATENT DOCUMENTS

| | | | | |
|---|---|---|---|---|
| 6,925,279 | B2 * | 8/2005 | Kamoshita et al. | 399/303 |
| 6,933,696 | B2 * | 8/2005 | Ueda et al. | 318/568.17 |
| 6,952,557 | B2 * | 10/2005 | Kobayashi | 399/394 |
| 7,054,586 | B2 * | 5/2006 | Kuroda | 399/302 |
| 7,263,314 | B2 * | 8/2007 | Ueda et al. | 399/167 |
| 7,558,510 | B2 * | 7/2009 | Iwasaki | 399/167 |
| 7,606,516 | B2 * | 10/2009 | Ueda et al. | 399/167 |
| 7,856,195 | B2 * | 12/2010 | Seto | 399/167 |
| 7,937,024 | B2 * | 5/2011 | Muto et al. | 399/167 |
| 7,970,317 | B2 * | 6/2011 | Seto | 399/167 |
| 8,160,480 | B2 * | 4/2012 | Mochizuki | 399/167 |
| 2003/0184851 | A1 * | 10/2003 | Tian et al. | 359/341.4 |
| 2004/0223785 | A1 * | 11/2004 | Abe | 399/167 |
| 2006/0002745 | A1 * | 1/2006 | Iwasaki | 399/299 |
| 2006/0133862 | A1 * | 6/2006 | Kuroda | 399/301 |
| 2007/0059041 | A1 * | 3/2007 | Iwasaki | 399/167 |
| 2007/0269230 | A1 * | 11/2007 | Hoshino et al. | 399/45 |
| 2008/0175612 | A1 | 7/2008 | Oikawa et al. | |
| 2008/0232880 | A1 | 9/2008 | Noguchi et al. | |
| 2008/0303202 | A1 * | 12/2008 | Noguchi et al. | 271/10.06 |
| 2009/0212491 | A1 * | 8/2009 | Noguchi et al. | 271/265.04 |

FOREIGN PATENT DOCUMENTS

| | | |
|---|---|---|
| JP | 2005-107118 | 4/2005 |
| JP | 2008-040289 | 2/2008 |
| JP | 2008-096640 | 4/2008 |
| JP | 2009-015287 | 1/2009 |

* cited by examiner

*Primary Examiner* — David Gray
*Assistant Examiner* — Francis Gray
(74) *Attorney, Agent, or Firm* — Harness, Dicke & Pierce, P.L.C.

(57) ABSTRACT

A transfer roller lies opposite to a supporting roller across an image carrying belt and abuts against the outer surface of the image carrying belt to form a transfer nip. A driving force transmission unit transmits driving force from a driving source to a driving roller. A drive control unit performs drive control of the driving source. A feedforward control unit performs feedforward control on the driving source via the drive control unit. An entry detecting unit detects entry of a sheet in the transfer nip. The feedforward control unit considers an entry detection signal output by the entry sensor as a trigger for performing feedforward control after a predetermined time.

7 Claims, 15 Drawing Sheets

TRANSFER DEVICE AND IMAGE FORMING APPARATUS

CROSS-REFERENCE TO RELATED APPLICATIONS

The present application claims priority to and incorporates by reference the entire contents of Japanese Patent Application No. 2008-223877 filed in Japan on Sep. 1, 2008.

BACKGROUND OF THE INVENTION

1. Field of the Invention

The present invention relates to a transfer device installable in an image forming apparatus and to an image forming apparatus that includes the transfer device.

2. Description of the Related Art

In color image forming apparatuses of recent years, an intermediate transfer system is being widely implemented to transfer an image on a sheet of, for example, transfer paper. In the intermediate transfer system, first, single-color toner images formed on photosensitive drums are primary-transferred and superimposed on one another on an intermediate transfer belt, which is an image carrying belt, in a primary transfer unit to obtain a full-color toner image. Then, the full-color toner image is secondary-transferred on a sheet of transfer paper in a secondary transfer unit. By implementing the intermediate transfer system, images can be formed on a variety of paper material such as thin paper, heavy paper, postcard paper, and paper envelope thereby enhancing the versatility of an image forming apparatus.

However, if a sheet having thickness above a certain level enters a secondary transfer nip in the secondary transfer unit, the constant speed of movement of the intermediate transfer belt changes for a short time. That causes distortion in an image formed by primary-transfer in the primary transfer unit.

More particularly, as shown in FIG. 23, entry of the front portion of a sheet S in a secondary transfer nip causes expansion in the secondary transfer nip corresponding to the thickness of the sheet S. Consequently, there is a sudden increase in the load on an opposite roller 116. The increase in load causes temporary deceleration in the rotating speed of the opposite roller 116. As a result, the length of an intermediate transfer belt 110 rolled at the opposite roller 116 drops below the length rolled at a driving roller 114. That causes a slack in the portion of the intermediate transfer belt 110 between the opposite roller 116 and the driving roller 114. On the other hand, the length of the intermediate transfer belt 110 rolled at a supporting roller 115 exceeds the length rolled at the opposite roller 116. That strains the portion of the intermediate transfer belt 110 between the opposite roller 116 and the supporting roller 115. In this way, the load variation caused due to the entry of the sheet S in the secondary transfer nip affects the stretched state of the intermediate transfer belt 110 and causes speed variance in the rotation thereof. If, at that time, single-color toner images formed on a plurality of photosensitive drums 104 are primary-transferred on the intermediate transfer belt 110, the transferred images get distorted due to the speed variance in the rotation of the intermediate transfer belt 110.

Meanwhile, to enhance the image quality, some image forming apparatuses include a transfer and fixing unit that not only secondary-transfers a toner image from an intermediate transfer belt on a sheet but also fixes the toner image on the image-recorded sheet. In that case too, if a sheet having thickness above a certain level enters the transfer and fixing unit, the constant speed of movement of the intermediate transfer belt decreases for a short time. That causes distortion in an image formed by primary-transfer in the primary transfer unit.

Such a problem can be solved by estimating, before a sheet enters the secondary transfer nip or the transfer and fixing unit, the timing at which the movement of the intermediate transfer belt undergoes speed variance due the entry of the sheet in the secondary transfer nip or in the transfer and fixing unit. Based on the estimated timing, a feedforward control can be performed such that, at the moment of entry of the sheet in the secondary transfer nip or in the transfer and fixing unit, the rotating speed of the intermediate transfer belt increases sufficiently to cancel out the speed variance.

Japanese Patent Application Laid-open No. 2005-107118 discloses a technology in which the time is measured from the start of registration roller clutching to the entry of a sheet in the second transfer unit. The measured time is then set as the timing for subsequent feedforward control with the start of registration roller clutching as the starting point.

However, in the image forming apparatus disclosed in Japanese Patent Application Laid-open No. 2005-107118, there occurs a substantial variability in the time from the start of registration roller clutching to the entry of a sheet in the second transfer unit. That causes an error in the estimated time. As a result, it becomes difficult to precisely set the timing of feedforward control. Moreover, even if the clutching time is stable, the timing of the entry of a sheet in the second transfer unit varies in practice for each sheet. Thus, accurate feedforward control is difficult to perform with the estimated time.

Meanwhile, even if an image forming apparatus implements, instead of the intermediate transfer system, a direct transfer system in which the image carrying belt is a photosensitive belt and a toner image formed on the photosensitive belt is directly transferred on a sheet in a transfer unit, the abovementioned problems occur in the transfer unit.

Moreover, the abovementioned problems occur not only when supporting members around which an image carrying belt is stretched are rollers as shown in FIG. 23, but also when the supporting members, other than a driving roller that drives the image carrying belt, are non-rotating supporting members.

SUMMARY OF THE INVENTION

It is an object of the present invention to at least partially solve the problems in the conventional technology.

According to one aspect of the present invention, there is provided a transfer device including a plurality of supporting members; an image carrying belt that is stretched around the supporting members in a loop-like manner and that makes an endless movement; a transfer roller that is disposed opposite to one of the supporting members across the image carrying belt and that abuts against an outer surface of the image carrying belt to form a transfer nip; a driving source that drives a driving roller that is one of the supporting members other than the one of the supporting members opposite to the transfer roller across the image carrying belt; a driving force transmission unit that transmits a driving force from the driving source to the driving roller; a drive control unit that performs drive control of the driving source; a feedforward control unit that performs a feedforward control on the driving source via the drive control unit to reduce speed variance in the endless movement of the image carrying belt caused due to an entry of a sheet in the transfer nip; and an entry detecting unit that detects an entry of a sheet in the transfer nip and outputs an entry detection signal. The transfer device transfers a visible image that has been formed on a surface of a latent-image carrying member on the outer surface of the image carrying belt and then transfers the visible image that has been transferred on the outer surface of the image carrying member on the sheet that has entered the transfer nip. The feedforward control unit considers the entry detection signal output by the entry sensor as a trigger for performing feedforward control after a predetermined time.

Furthermore, according to another aspect of the present invention, there is provided an image forming apparatus including a latent-image carrying member that carries a latent image; a developing unit that develops the latent image carried by the latent-image carrying member into a visible image; and a transfer device that transfers the visible image developed on the latent-image carrying member on a sheet. The transfer device includes a plurality of supporting members, an image carrying belt that is stretched around the supporting members in a loop-like manner and that makes an endless movement, a transfer roller that is disposed opposite to one of the supporting members across the image carrying belt and that abuts against an outer surface of the image carrying belt to form a transfer nip, a driving source that drives a driving roller that is one of the supporting members other than the one of the supporting members opposite to the transfer roller across the image carrying belt, a driving force transmission unit that transmits a driving force from the driving source to the driving roller, a drive control unit that performs drive control of the driving source, a feedforward control unit that performs a feedforward control on the driving source via the drive control unit to reduce speed variance in the endless movement of the image carrying belt caused due to an entry of a sheet in the transfer nip, and an entry detecting unit that detects an entry of a sheet in the transfer nip and outputs an entry detection signal. The transfer device transfers the visible image on the outer surface of the image carrying belt and then transfers the visible image that has been transferred on the outer surface of the image carrying member on the sheet that has entered the transfer nip. The feedforward control unit considers the entry detection signal output by the entry sensor as a trigger for performing feedforward control after a predetermined time.

As described below in detail, an entry of a sheet in a secondary transfer nip affects the stretched state of an image carrying belt and causes speed variance in the movement thereof after a predetermined time. Because of that time difference, the timing at which the sheet enters the secondary transfer nip can be considered as a trigger for performing a feedforward control.

It was found by the inventors of the present invention that the time difference between the entry of the sheet in the secondary transfer nip and the occurrence of speed variance in the movement of the image carrying belt has a smaller variability than the variability in the time required for a sheet to enter a secondary transfer nip in the abovementioned conventional configuration.

Thus, according to the present invention, an entry of a sheet in the secondary transfer nip is detected and an entry detection signal is considered as a trigger for performing feedforward control after a predetermined time. Because the time difference between the entry of the sheet in the secondary transfer nip and the occurrence of speed variance in the movement of the image carrying belt has a substantially small variability, it is possible to accurately match the timing of the feedforward control with the timing at which speed variance occurs in the movement of the image carrying belt, in contrast to the conventional method of performing the feedforward control at an estimated timing of the entry of the sheet in the secondary transfer nip.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention are described in detail below with reference to the accompanying drawings. The present invention is not limited to these exemplary embodiments.

Figure 2:
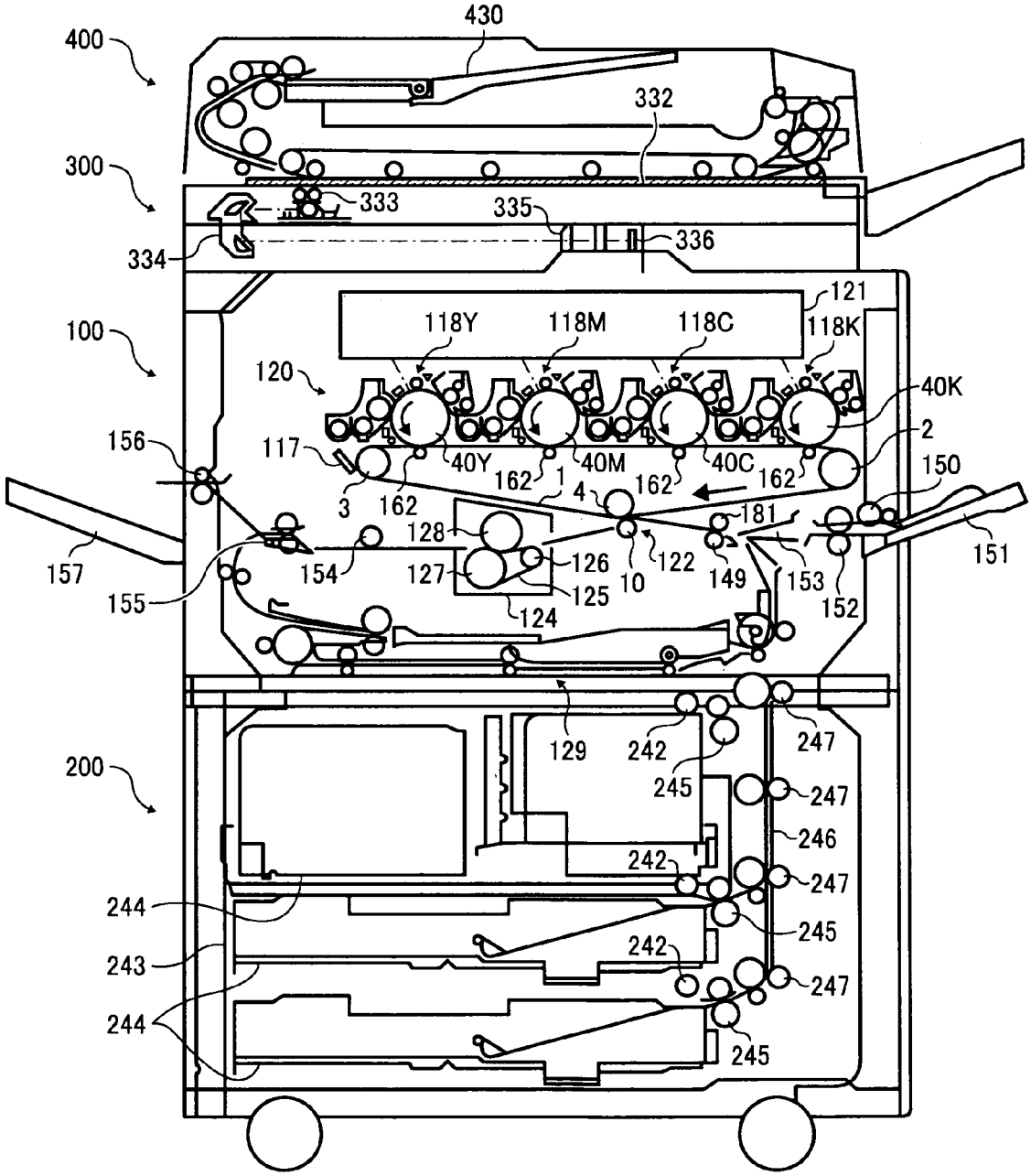
FIG. 2 is a schematic diagram of an exemplary image forming apparatus according to the first embodiment.

FIG. 2 is a schematic diagram of an exemplary image forming apparatus according to a first embodiment of the present invention. In the image forming apparatus, which is assumed to be a copying machine, a main body 100 is mounted on a paper feeding table 200. Moreover, a scanning unit 300 and an automatic document feeding (ADF) unit 400 are mounted on the main body 100 in that order.

The image forming apparatus shown in FIG. 2 is an electrophotographic apparatus that implements a tandem-type intermediate transfer (indirect transfer) system. More particularly, in the center of the main body 100 is disposed an intermediate transfer device that includes an intermediate transfer belt 1, which is an endless belt, as an intermediate transfer member. The intermediate transfer belt 1 is stretched around a driving roller 2 and supporting rollers 3 and 4. The driving roller 2 and the supporting rollers 3 and 4 are rotated to rotate the intermediate transfer belt 1 in the clockwise direction. Hereinafter, partial movement during the rotation of the intermediate transfer belt 1 is referred to simply as movement. On the left side of the supporting roller 3 with reference to FIG. 2 is disposed a belt cleaning unit 117 that, after an image is secondary-transferred from the intermediate transfer belt 1, removes residual toner from the surface of the intermediate transfer belt 1. The supporting roller 3 also functions as a tension roller to maintain the intermediate transfer belt 1 at a constant tension. To assist that function, an elastic material (not shown) such as a spring is disposed that applies pressure from the inside of the intermediate transfer belt 1 to the outside.

A tandem image forming unit 120 is disposed over that portion of the intermediate transfer belt 1 which is stretched between the driving roller 2 and the supporting roller 3 and which is referred to as a primary transfer surface. In other words, the tandem image forming unit 120 is disposed over the primary transfer surface that is stretched between the upstream side of the driving roller 2 in the direction of movement of the intermediate transfer belt 1 and the downstream side of the supporting roller 3 in the direction of movement of the intermediate transfer belt 1. The tandem image forming unit 120 includes four image forming units 118Y, 118M, 118C, and 118K that are horizontally arranged in that order along the direction of movement of the intermediate transfer belt 1. The image forming units 118Y, 118M, 118C, and 118K respectively form images in yellow (Y), magenta (M), cyan (C), and black (K). Above the tandem image forming unit 120 is disposed a light exposing unit 121. Meanwhile, the driving roller 2 is used in rotating the intermediate transfer belt 1.

A secondary transfer unit 122 is disposed on the opposite side of the tandem image forming unit 120 across the intermediate transfer belt 1. In the secondary transfer unit 122, a pressure roller 10, which functions as a secondary transfer roller, is positioned in a pressing manner against the supporting roller 4 across the intermediate transfer belt 1. In the secondary transfer unit 122, an image on the intermediate transfer belt 1 is secondary-transferred on a sheet of recording member and the image-recorded sheet is conveyed to a fixing unit 124 with a sheet conveying function. The fixing unit 124 is disposed transversely beside the secondary transfer unit 122 and fixes the image on the image-recorded sheet.

More particularly, the fixing unit 124 includes a fixing belt 125, a heating roller 126, a fixing roller 127, and a pressure roller 128. The fixing belt 125 is stretched around the heating roller 126 and the fixing roller 127. The pressure roller 128 is pressure-welded with the fixing roller 127 across the fixing belt 125. The heating roller 126 also functions as a tension roller to maintain the fixing belt 125 at a constant tension. To assist that function, an elastic material (not shown) such as a spring is disposed that applies pressure from the inside of the fixing belt 125 to the outside. The heating roller 126 heats the fixing belt 125 to a temperature necessary for image fixing. The image that has been secondary-transferred on the image-recorded sheet is subjected to heat and pressure such that it gets fixed on the image-recorded sheet. Meanwhile, instead of implementing a belt fixing system as described above, it is also possible to implement a roller fixing system that includes the heating roller 126 and the fixing roller 127.

A sheet reversing unit 129 is disposed beneath the secondary transfer unit 122 and the fixing unit 124, and parallel to the tandem image forming unit 120. The sheet reversing unit 129 reverses the image-recorded sheet when duplex image formation is to be performed.

To obtain a copy of an original from the image forming apparatus, first, the original is placed on a platen 430 in the ADF unit 400. Alternatively, the ADF unit 400 is opened and the original is placed on an exposure glass 332 in the scanning unit 300. Then, the ADF unit 400 is closed and is held pressed from above. Subsequently, a start switch (not shown) is pressed to start the copying operation. If the original is placed on the platen 430 in the ADF unit 400, then pressing of the start switch results in conveyance of the original on the exposure glass 332 and activation of the scanning unit 300. On the other hand, if the original is directly placed on the exposure glass 332, then pressing of the start switch results in activation of the scanning unit 300. Then, a first carriage 333 and a second carriage 334 in the scanning unit 300 start moving. The first carriage 333 includes a light source (not shown) for emitting light to the original and reflects the light reflected from the original toward the second carriage 334. The light further reflects from a mirror (not shown) on the second carriage 334 and falls on a reading sensor 336 via an imaging lens 335. As a result, the contents on the original are read by the scanning unit 300.

Alongside the reading operation, a driving source (not shown) rotates the driving roller 2. The supporting rollers 3 and 4 rotate as driven rollers. Consequently, the intermediate transfer belt 1 rotates in the clockwise direction. At the same time, photosensitive drums 40Y, 40M, 40C, and 40K disposed in the image forming units 118Y, 118M, 118C, and 118K, respectively, are rotated in the counterclockwise direction. The photosensitive drums 40Y, 40M, 40C, and 40K are then exposed to light corresponding to color images in yellow, magenta, cyan, and black colors, respectively, according to the image information read by the scanning unit 300. As a result, electrostatic latent images corresponding to yellow, magenta, cyan, and black colors are formed on the surfaces of the photosensitive drums 40Y, 40M, 40C, and 40K, respectively. A developing unit (not shown) corresponding to each of the photosensitive drums 40Y, 40M, 40C, and 40K develops the electrostatic latent image on the respective photosensitive drums 40Y, 40M, 40C, and 40K into single-color toner images of yellow, magenta, cyan, and black colors. Each of the four single-color toner images is then primary-transferred and superimposed on one another on the rotating intermediate transfer belt 1 to form a compound color image (full-color toner image).

Meanwhile, pressing the start switch also results in selective rotation of one of a plurality of feeding rollers 242 disposed in a plurality of sheet storing cassettes 244, which are arranged one above another in a paper bank 243 inside the paper feeding table 200. Consequently, the sheets stored in the sheet storing cassette corresponding to the rotating feeding roller 242 are fed. A corresponding separating roller 245 then separates the topmost of the sheets and conveys it in a sheet conveying path 246. A plurality of conveying rollers 247 guide the separated sheet in a sheet conveying path inside the main body 100. The sheet then reaches a registration roller 149, which is not yet rotating, and abuts against it. Thus, the conveyance of the sheet comes to a temporary halt. In the case of using a manual feeding tray 151, a feeding roller 150 rotates to feed the sheets from the manual feeding tray 151. A separating roller 152 separates the topmost of the sheets and guides it in a manual sheet conveying path 153. The guided sheet then reaches the registration roller 149 and abuts against it. Thus, the conveyance of the sheet comes to a temporary halt.

The registration roller 149 starts rotating at the timing when the compound color image formed on the intermediate transfer belt 1 reaches the secondary transfer unit 122. Consequently, the sheet is conveyed through a nip formed between the intermediate transfer belt 1 and the pressure roller 10 such that the compound color image gets secondary-transferred on the sheet. The image-recorded sheet is then conveyed to the fixing unit 124, which applies heat and pressure to fix the image on the image-recorded sheet. Subsequently, a conveying roller 154 conveys the image-recorded sheet toward a catch tray 157. A switching claw 155 then selects a conveying path in which a discharging roller 156 discharges the image-recorded sheet to the catch tray 157. Meanwhile, for duplex image formation, the switching claw 155 selects a conveying path in which the image-recorded sheet is conveyed to the sheet reversing unit 129. Subsequently, the sheet reversing unit 129 reverses the image-recorded sheet and guides it to the secondary transfer position such that an image is transferred on the reverse side of the image-recorded sheet. The discharging roller 156 then discharges the image-recorded sheet with images formed on both sides thereof to the catch tray 157.

Once the compound color image is secondary-transferred on the sheet, the belt cleaning unit 117 removes the residual toner from the surface of the intermediate transfer belt 1. Thus, the intermediate transfer belt 1 becomes ready for subsequent image formation by the tandem image forming unit 120. Meanwhile, although the registration roller 149 is generally connected to ground, it is also possible to apply a bias voltage to the registration roller 149 for removing paper powder of the sheets.

Meanwhile, when the image forming apparatus is instructed, as is often the case, to obtain a monochrome copy in black color of an original, a displacing unit (not shown) displaces the intermediate transfer belt 1 away from the photosensitive drums 40Y, 40C, and 40M. Moreover, the rotation of the photosensitive drums 40Y, 40C, and 40M is temporarily stopped. Thus, only the photosensitive drum 40K is maintained rotating and in contact with the intermediate transfer belt 1. Subsequently, an electrostatic latent image is primary-transferred on the intermediate transfer belt 1 only from the photosensitive drum 40K and is developed into a black toner image.

Figure 3:
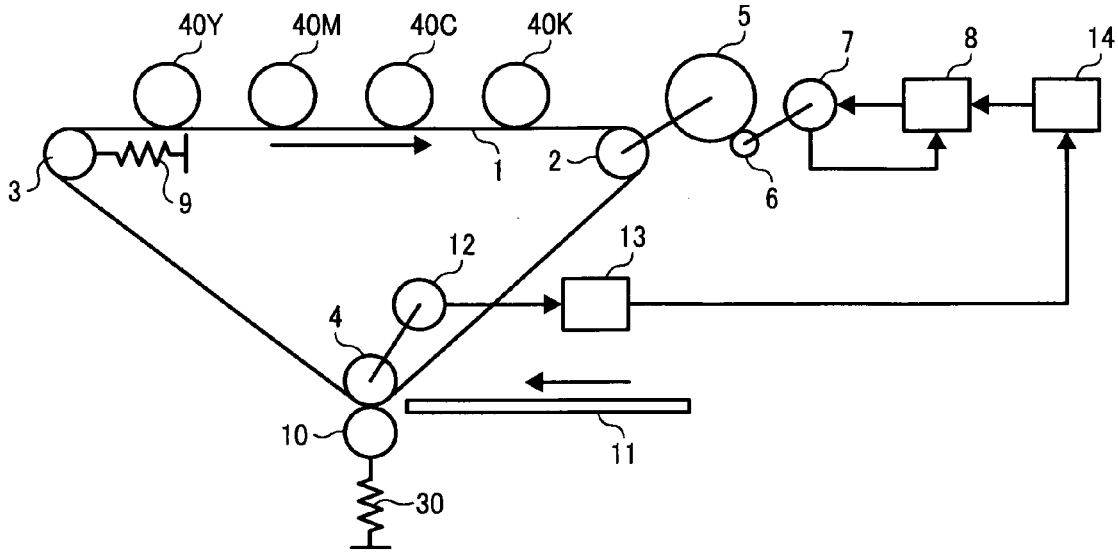
FIGS. 3 and 4 are schematic diagrams of exemplary configurations of an intermediate transfer device according to the first embodiment.

Given below is the detailed description of the intermediate transfer device. FIG. 3 is a schematic diagram of an exemplary configuration of the intermediate transfer device. As shown in FIG. 3, the intermediate transfer belt 1 is stretched around the driving roller 2 and the supporting rollers 3 and 4. The driving roller 2 is used to rotate the intermediate transfer belt 1 in the clockwise direction.

For that, the driving roller 2 is coupled with a driving source 7 via a driving force transmission unit that includes a large-diameter gear 5 and a small-diameter gear 6. The driving source 7 rotates the driving roller 2 in the clockwise direction. Meanwhile, instead of using the large-diameter gear 5 and the small-diameter gear 6, it is also possible to use a gear and a synchronous belt, a pulley and a V-belt, or a planetary gear as the driving force transmission unit.

The driving source 7 can be a brushless direct-current (DC) motor, a pulse motor, an ultrasonic motor, or a direct drive motor. The driving source 7 is drive-controlled by a drive control unit 8 to obtain certain rotation information.

The drive control unit 8 performs a feedback control with the rotation information output by the driving source 7. If it is possible to obtain the rotation information of the intermediate transfer belt 1, the driving roller 2, the supporting roller 3, or the supporting roller 4, then that information can be fed back for control to the drive control unit 8. Meanwhile, if the driving source 7 is a pulse motor or an ultrasonic motor, then an open-loop control can be performed instead of the feedback control. Moreover, if the driving source 7 is an ultrasonic motor or a direct drive motor, it is possible to directly rotate the driving roller 2 without using the driving force transmission unit.

The primary transfer surface of the intermediate transfer belt 1 stretched between the driving roller 2 and the supporting roller 3 moves from left to right with reference to FIG. 3. The photosensitive drums 40Y, 40M, 40C, and 40K are disposed to abut from above against the primary transfer surface of the intermediate transfer belt 1. A single-color toner image is primary-transferred on the rotating intermediate transfer belt 1 from each of the photosensitive drums 40Y, 40M, 40C, and 40K.

Figure 4:
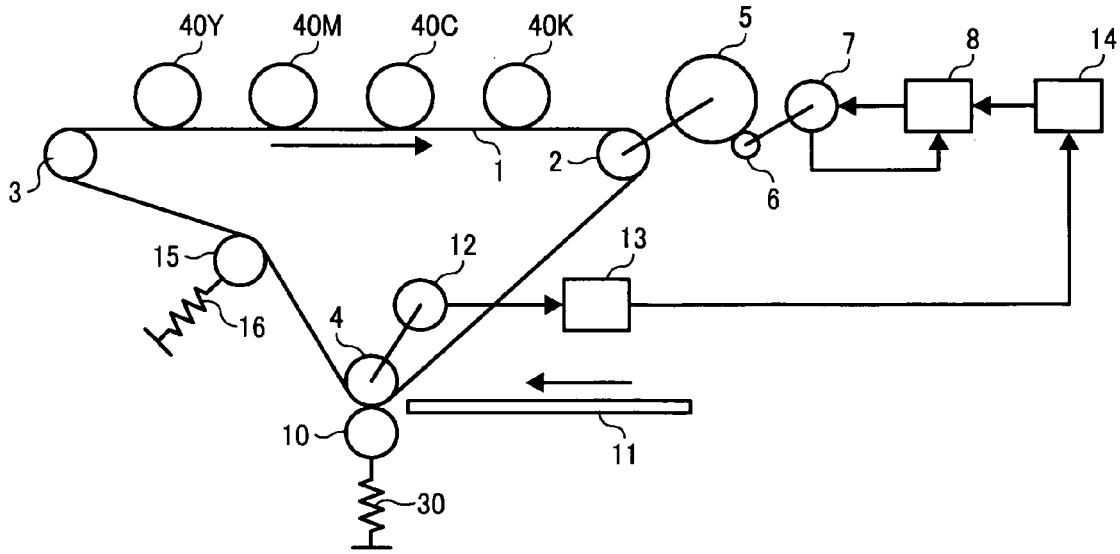

In the exemplary configuration shown in FIG. 3, the supporting roller 3 and an elastic member 9 constitute a tension applying unit that applies tension to the intermediate transfer belt 1. Alternatively, as shown in FIG. 4, it is also possible to dispose a tension applying roller 15 in an abutting manner against the outer surface of the intermediate transfer belt 1 at a position on the upstream side of the supporting roller 3 in the direction of movement of the intermediate transfer belt 1 but on the downstream side of the supporting roller 4 in the direction of movement of the intermediate transfer belt 1. Moreover, an elastic member 16 is disposed to maintain the tension applying roller 15 biased against the intermediate transfer belt 1.

The supporting roller 4 and the pressure roller 10 constitute a secondary transfer unit. An elastic member 30 is disposed that pressure-welds the pressure roller 10 to the supporting roller 4 to form a secondary transfer nip, at which a compound color image formed on the intermediate transfer belt 1 is secondary-transferred on a sheet 11.

Meanwhile, in the exemplary configurations of the intermediate transfer device shown in FIGS. 3 and 4, it is possible to suitably dispose more supporting rollers to support the intermediate transfer belt 1 as long as the arrangement order of the driving roller 2, the secondary transfer unit, and the tension applying unit is same with respect to the primary transfer surface of the intermediate transfer belt 1 along the direction of movement thereof.

Given below is the description of a feedforward control (FF control) performed according to the first embodiment.

Figure 5:
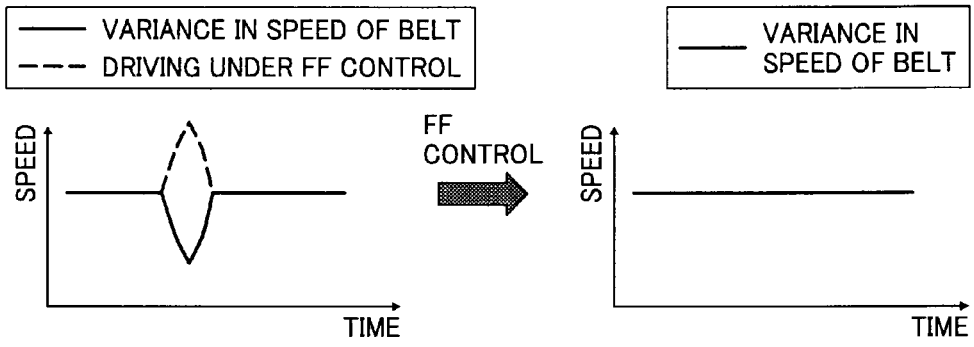
FIG. 5 is a schematic diagram for explaining the concept of the feedforward control.

FIG. 5 is a schematic diagram for explaining the concept of the feedforward control. The feedforward control is performed when the sheet 11 enters the secondary transfer nip in the secondary transfer unit. More particularly, the entry of the sheet 11 in the secondary transfer nip causes speed variance in the movement of the primary transfer surface of the intermediate transfer belt 1. In the feedforward control, the driving source 7 is so controlled that, at the timing of occurrence of the speed variance in the movement of the primary transfer surface, the intermediate transfer belt 1 rotates at a speed that cancels out the speed variance. That enables maintaining the rotation of the intermediate transfer belt 1 at a constant speed.

Figure 6:
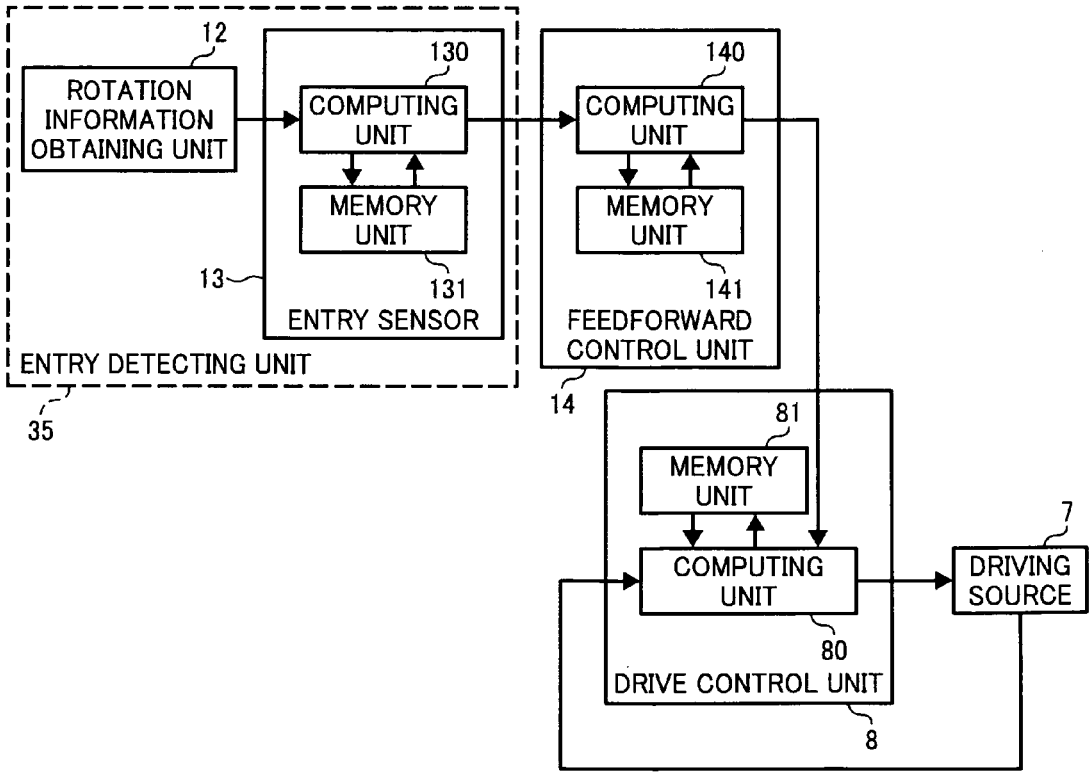
FIG. 6 is a block diagram of essential parts in the feedforward control.

The feedforward control is performed with a rotation information obtaining unit 12, an entry sensor 13, and a feedforward control unit 14 (see FIGS. 3 and 4). The rotation information obtaining unit 12 and the entry sensor 13 constitute an entry detecting unit 35. FIG. 6 is a schematic diagram of an exemplary configuration of the drive control unit 8, the entry detecting unit 35, and the feedforward control unit 14 that are used in the feedforward control. As shown in FIG. 6, each of the drive control unit 8, the entry sensor 13, and the feedforward control unit 14 includes a memory unit and a computing unit. If it is possible to use a high-end central processing unit (CPU), then all the functions necessary in the feedforward control can be achieved by using the single CPU.

In the drive control unit 8, a computing unit 80 compares speed information fed back from driving source 7 with a target speed stored in advance in a memory unit 81, calculates a driving instruction value such that the difference between the fed-back speed and the target speed is small, and accordingly controls the driving source 7. Meanwhile, the drive control unit 8 can also be configured as an analog circuit, in case of which, for example, a phase-locked loop (PLL) control is performed.

The rotation information obtaining unit 12 obtains rotation information of the supporting roller 4. For that, for example, it is possible to obtain angular information by disposing a rotary encoder on the shaft of the supporting roller 4 or obtain the angular speed by using a tachometer generator.

In the entry sensor 13, a computing unit 130 compares the rotation information of the supporting roller 4 obtained by the rotation information obtaining unit 12 with a threshold value stored in advance in a memory unit 131 and, based on the comparison, detects whether the sheet 11 has entered the secondary transfer nip. If the sheet 11 is detected to have entered the secondary transfer nip, the computing unit 130 outputs an entry detection signal to the feedforward control unit 14. If the rotation information obtaining unit 12 obtains the angular information of the supporting roller 4, then the computing unit 130 can be configured to convert the angular information into angular speed or surface speed of the supporting roller 4 and compare it with a corresponding threshold value.

In the feedforward control unit 14, a computing unit 140 considers the output of the entry detection signal by the entry sensor 13 as a trigger for starting a count and, when the count matches with an output timing of a feedforward target value stored in advance in a memory unit 141, outputs the feedforward target value to the drive control unit 8. The computing unit 80 in the drive control unit 8 adds the feedforward target value and a feedback target value and outputs the added value to the driving source 7.

Figure 1:
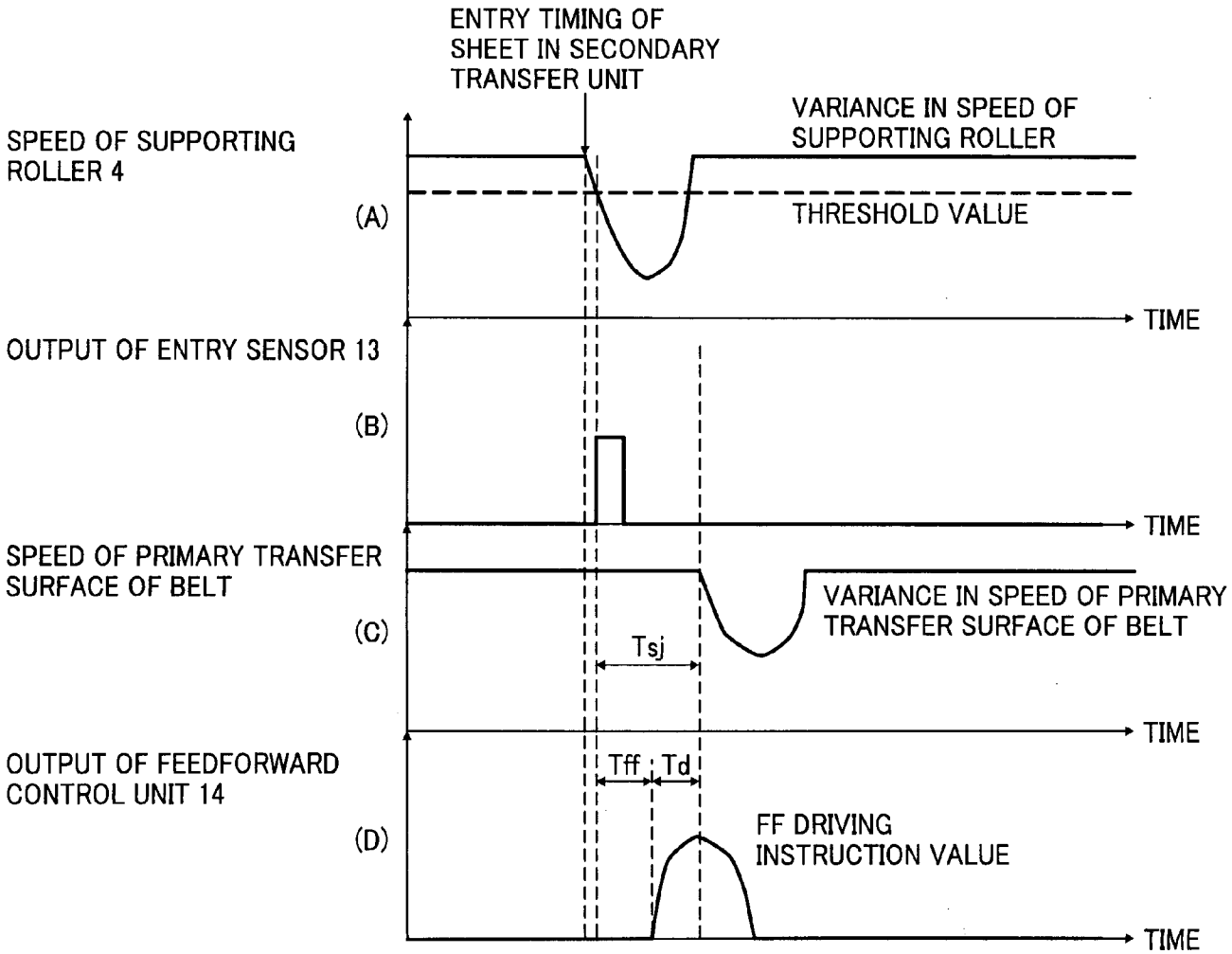
FIG. 1 is a schematic diagram for explaining the operations in a feedforward control performed according a first embodiment of the present invention.

The detailed description of the feedforward control operation is given below with reference to FIG. 1. In FIG. 1, (A) indicates the speed variance in the rotation of the supporting roller 4 in comparison with the threshold value and (B) indicates the output of the entry sensor 13. The computing unit 130 in the entry sensor 13 converts the rotation information obtained by the rotation information obtaining unit 12 into speed information and compares it with the threshold value stored in advance in the memory unit 131. Subsequently, the computing unit 130 outputs an entry detection signal at the timing when the speed variance drops below the threshold value. In FIG. 1, (C) indicates the speed variance in the movement of the primary transfer surface of the intermediate transfer belt 1. As can be seen in (A) and (C) in FIG. 1, there is a time difference Tsj (described later) between the occurrence of the speed variance in the rotation of the supporting roller 4 and the occurrence of the speed variance in the movement of the primary transfer surface of the intermediate transfer belt 1 caused due to the entry of the sheet 11 in the secondary transfer nip. Meanwhile, the time difference Tsj has a smaller variability than the variability in the time required for a sheet to enter a secondary transfer nip in the abovementioned conventional configuration.

In FIG. 1, (D) indicates the output of the feedforward control unit 14. After the feedforward control unit 14 outputs the feedforward target value, the rotation of the driving roller 2 is controlled after a time delay Td that occurs due to, for example, the mechanical time constant of the driving source 7. Thus, upon receiving the entry detection signal from the entry sensor 13, the feedforward control unit 14 outputs the feedforward target value after a time Tff (=Tsj−Td). More particularly, the computing unit 140 of the feedforward control unit 14 starts the count instantly upon receiving the entry detection signal from the entry sensor 13 and, when the count matches with the time Tff stored in advance in the memory unit 141, outputs the feedforward target value. Herein, since the values of the time difference Tsj and the time delay Td have only small variability, it is conceivable to calculate the time Tff from the values of Tsj and Td measured in advance and store the calculated time Tff in the memory unit 141. That enables a stable feedforward control on a consistent basis.

Figure 7:
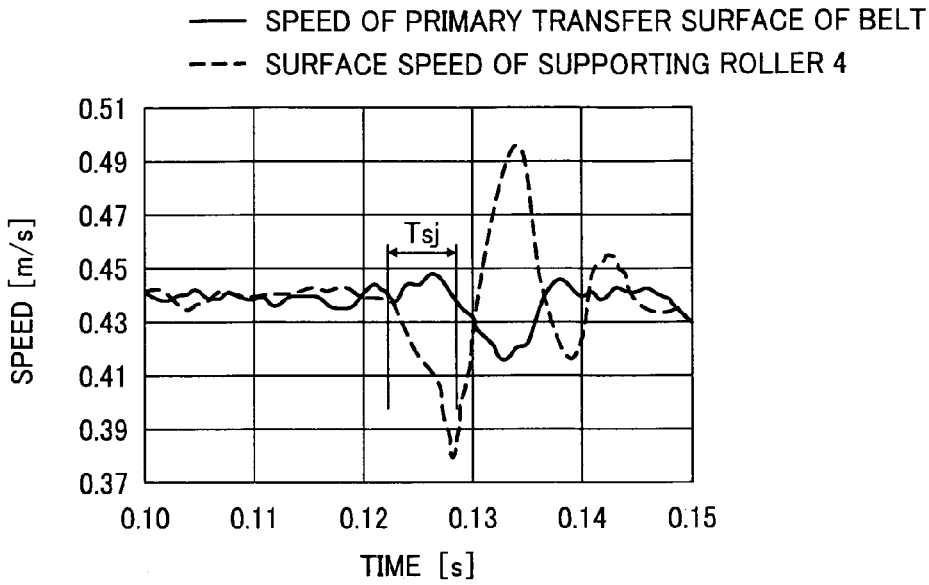
FIG. 7 is a graph that shows a relation between surface speed of a supporting roller and movement speed of a primary transfer surface of an intermediate transfer belt.

Given below is the detailed description regarding the time difference Tsj shown in FIG. 1. FIG. 7 is a graph that shows experimental data regarding a relation between the measured surface speed of the supporting roller 4 and the measured movement speed of the primary transfer surface of the intermediate transfer belt 1. As shown in FIG. 7, the speed variance in the movement of the primary transfer surface of the intermediate transfer belt 1 occurs with the time difference Tsj after the rotation of the supporting roller 4 undergoes speed variance. Moreover, the timing at which the speed variance occurs in the rotation of the supporting roller 4 matches with the timing at which the sheet 11 enters the secondary transfer nip.

Figure 8:
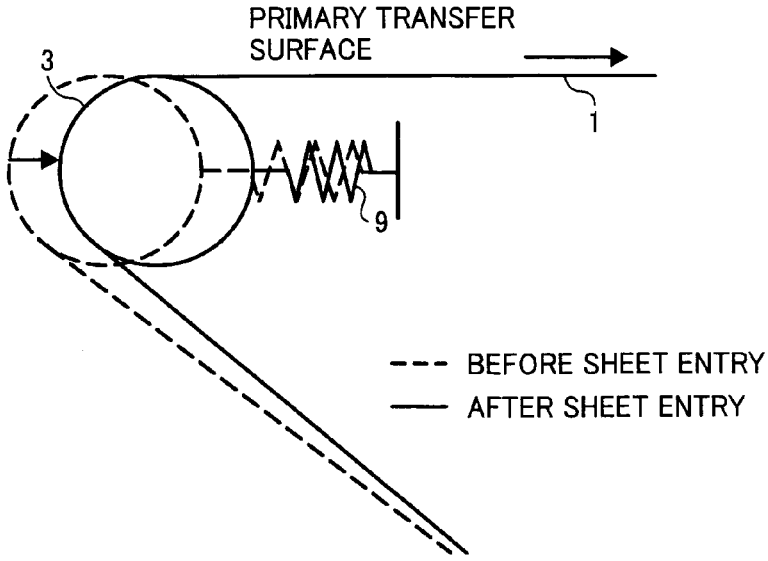
FIGS. 8 and 9 are schematic diagrams for explaining exemplary states of the intermediate transfer belt before and after an entry of a sheet in a secondary transfer nip.
Figure 9:
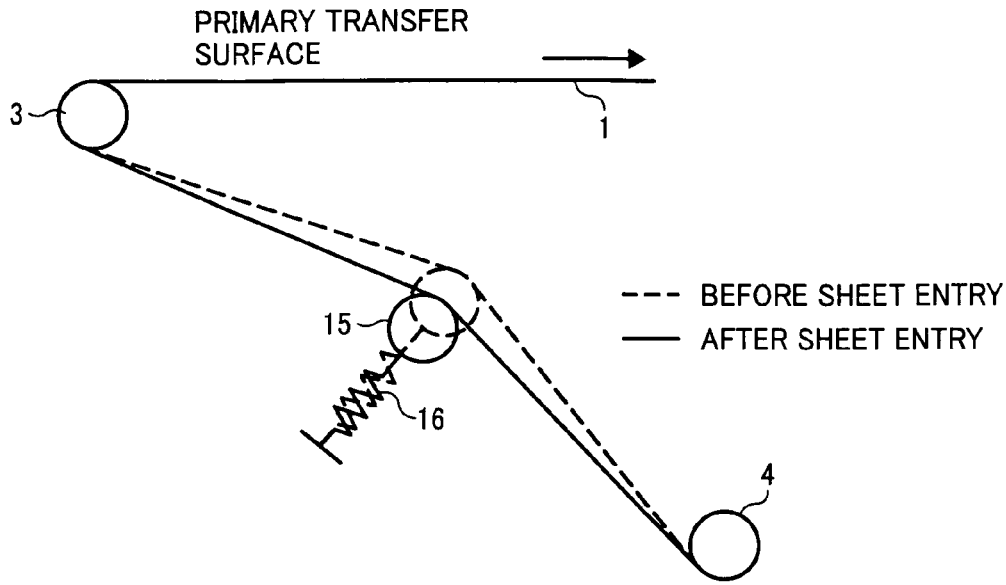

The entry of the sheet 11 in the secondary transfer nip increases the load on the secondary transfer unit thereby causing an increase in tension in the portions of the intermediate transfer belt 1 that are being stretched around the driving roller 2 and the supporting rollers 3 and 4. When such an increase in tension occurs in the configuration shown in FIG. 3, the elastic member 9 of the tension applying unit contracts to move the supporting roller 3 to the right side as shown in FIG. 8. That relives the tension in the intermediate transfer belt 1 at the supporting roller 3. Consequently, the loop of the intermediate transfer belt 1 stretched around the driving roller 2 and the supporting rollers 3 and 4 shortens in length as compared to its original state when the sheet 11 has not yet entered the secondary transfer nip. Similarly, when there is an increase in tension in the configuration shown in FIG. 4, the elastic member 16 contracts to move the tension applying roller 15 away from the intermediate transfer belt 1 as shown in FIG. 9 such that the tension is relieved. Consequently, the loop of the intermediate transfer belt 1 stretched around the driving roller 2 and the supporting rollers 3 and 4 shortens in length as compared to its original state when the sheet 11 has not yet entered the secondary transfer nip. The primary transfer surface of the intermediate transfer belt 1 can move at steady-state speed only corresponding to the difference in the loop length of the intermediate transfer belt 1 before and after the entry of the sheet 11 in the secondary transfer nip. In other words, the primary transfer surface of the intermediate transfer belt 1 can move at steady-state speed only for the time period in which the loop of the intermediate transfer belt 1 shortens in length from its original state after the entry of the sheet 11 in the secondary transfer nip. That causes the time difference Tsj between the occurrence of the speed variance in the rotation of the supporting roller 4 and the occurrence of the speed variance in the movement of the primary transfer surface of the intermediate transfer belt 1.

The time difference Tsj can be used in detecting the entry of the sheet 11 in the secondary transfer nip and the entry detection signal can be considered as a trigger for performing the feedforward control. Meanwhile, for a configuration of the intermediate transfer device in which the time difference Tsj does not occur, it becomes necessary to dispose, for example, a sheet detecting sensor for estimating the timing at which the sheet 11 enters the secondary transfer nip or the timing at which speed variance occurs in the movement of the primary transfer surface of the intermediate transfer belt 1. However, in such a case, various factors such as detection errors in the sheet detecting sensor or variability in the conveying speed of the sheet 11 make it difficult to accurately estimate the timing. As a result, it becomes difficult to perform the feedforward control equivalent to that according to the first embodiment.

Figure 10:
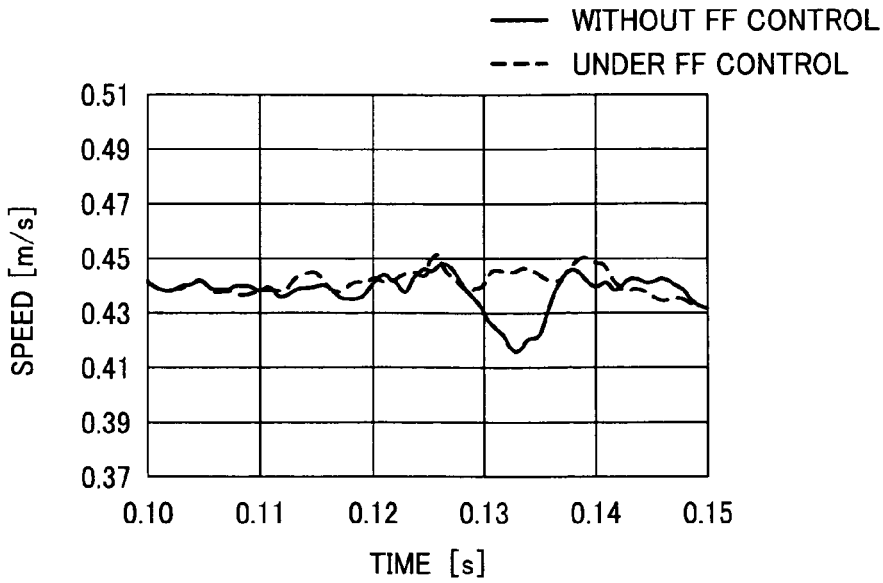
FIG. 10 is a graph that shows movement speed of the primary transfer surface of the intermediate transfer belt under the feedforward control in comparison with movement speed thereof without the feedforward control.

FIG. 10 is a graph that shows experimental data regarding movement speed of the primary transfer surface of the intermediate transfer belt when the feedforward control is performed in comparison with movement speed thereof when the feedforward control is not performed. As is clear from FIG. 10, the speed variance that occurs when no feedforward control is performed can be curbed by performing the feedforward control.

Figure 11:
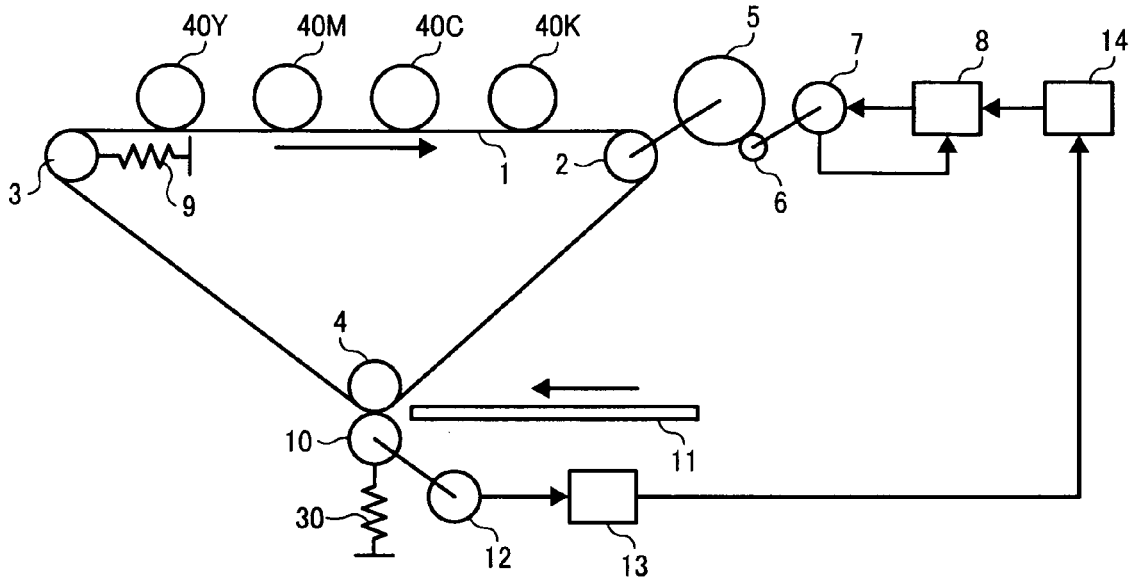
FIG. 11 is a schematic diagram of an another exemplary configuration of the intermediate transfer device according to the first embodiment.
Figure 12:
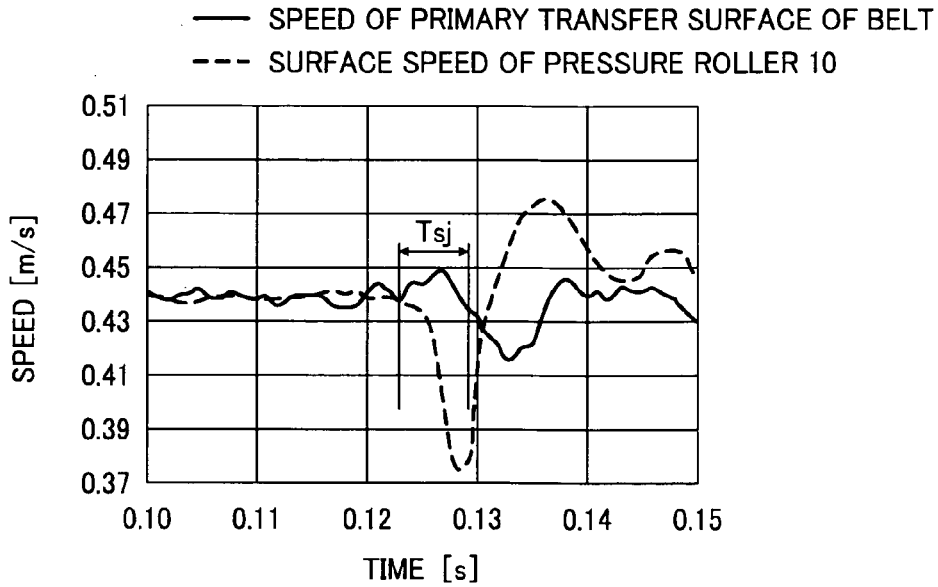
FIG. 12 is a graph that shows a relation between surface speed of a pressure roller and movement speed of the primary transfer surface of the intermediate transfer belt.

Meanwhile, in the first embodiment, the rotation information obtaining unit 12 is described to obtain the rotation information of the supporting roller 4. Instead, it is also possible to configure the rotation information obtaining unit 12 to obtain the rotation information of the pressure roller 10. An exemplary configuration for that case is shown in FIG. 11. The configuration shown in FIG. 11 is feasible because the entry of the sheet 11 in the secondary transfer nip causes speed variance in the rotation of the pressure roller 10 in an identical manner to that of the supporting roller 4. Thus, as shown in FIG. 12, there is the time difference Tsj between the occurrence of the speed variance in the rotation of the pressure roller 10 and occurrence of the speed variance in the movement of the primary transfer surface of the intermediate transfer belt 1. Hence, it is possible to perform the feedforward control in the configuration shown in FIG. 11 and obtain advantages identical to those obtained in the configurations shown in FIGS. 3 and 4.

Given below is the detailed description of the intermediate transfer device according to a second embodiment of the present invention.

According to the second embodiment, information on the displacement (displacement information) of the pressure roller 10 caused due to the entry of the sheet 11 in the secondary transfer nip is obtained. The displacement information is used in detecting the entry of the sheet 11 in the secondary transfer nip and the detection result is considered as a trigger for performing the feedforward control.

Figure 13:
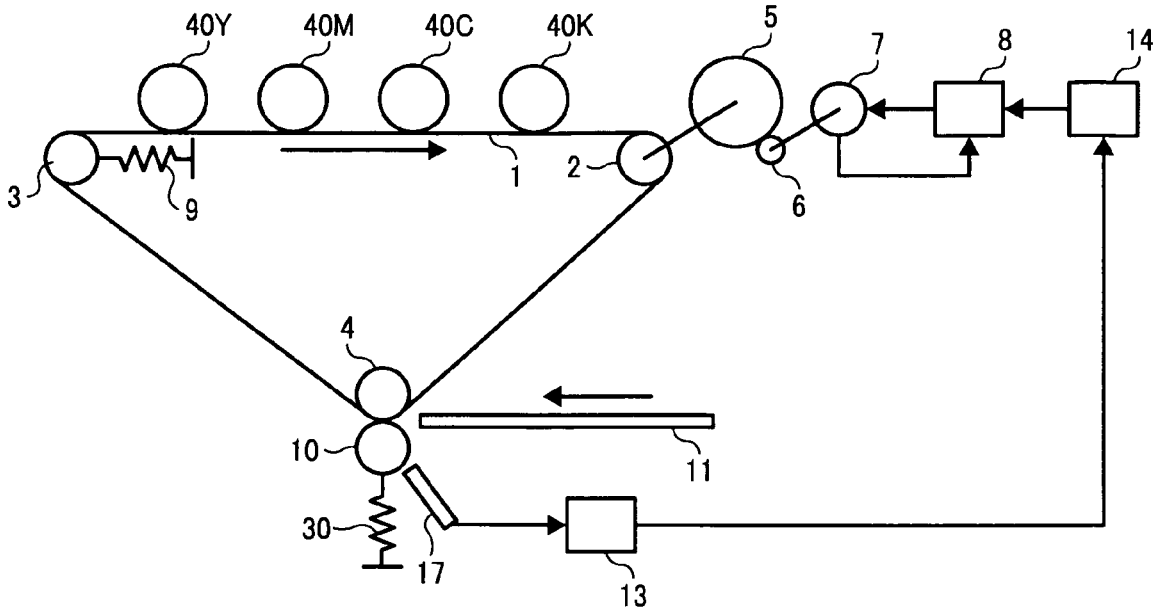
FIG. 13 is a schematic diagram of an exemplary configuration of the intermediate transfer device according to a second embodiment of the present invention.

FIG. 13 is a schematic diagram of an exemplary configuration of the intermediate transfer device according to the second embodiment. As shown in FIG. 13, a displacement information obtaining unit 17 is disposed to obtain the displacement information of the pressure roller 10, which is biased by the elastic member 30. The displacement information obtaining unit 17 can be a sensor such as a piezoelectric displacement sensor or an optical displacement sensor.

The entry of the sheet 11 in the secondary transfer nip causes the pressure roller 10 to move against the bias of the elastic member 30 by a distance corresponding to about the thickness of the sheet 11. With reference to FIG. 13, the pressure roller 10 moves downward against the bias of the elastic member 30 by a distance corresponding to about the thickness of the sheet 11.

Figure 14:
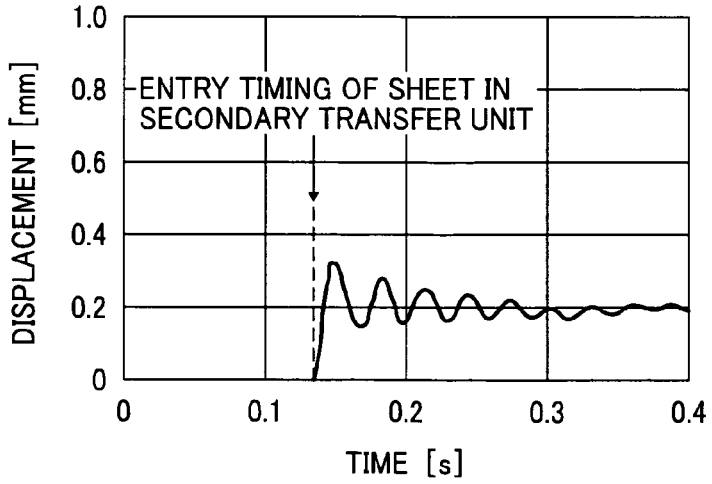
FIG. 14 is a graph that shows amount of displacement of the pressure roller caused due to the entry of the sheet in the secondary transfer nip.

FIG. 14 is a graph that shows data of the amount of displacement of the pressure roller 10 when the sheet 11 enters the secondary transfer nip. The graph in FIG. 14 shows the absolute value of the amount of displacement of the pressure roller 10 from its position when the sheet 11 has not yet entered the secondary transfer nip. The displacement of the pressure roller 10 caused due to the entry of the sheet 11 in the secondary transfer nip occurs at the same timing at which speed variance occurs in the supporting roller 4 or in the pressure roller 10. Thus, by using the displacement information of the pressure roller 10 to detect the entry of the sheet 11 in the secondary transfer nip, it is possible to perform the feedforward control in an identical manner to that described in the first embodiment.

Figure 15:
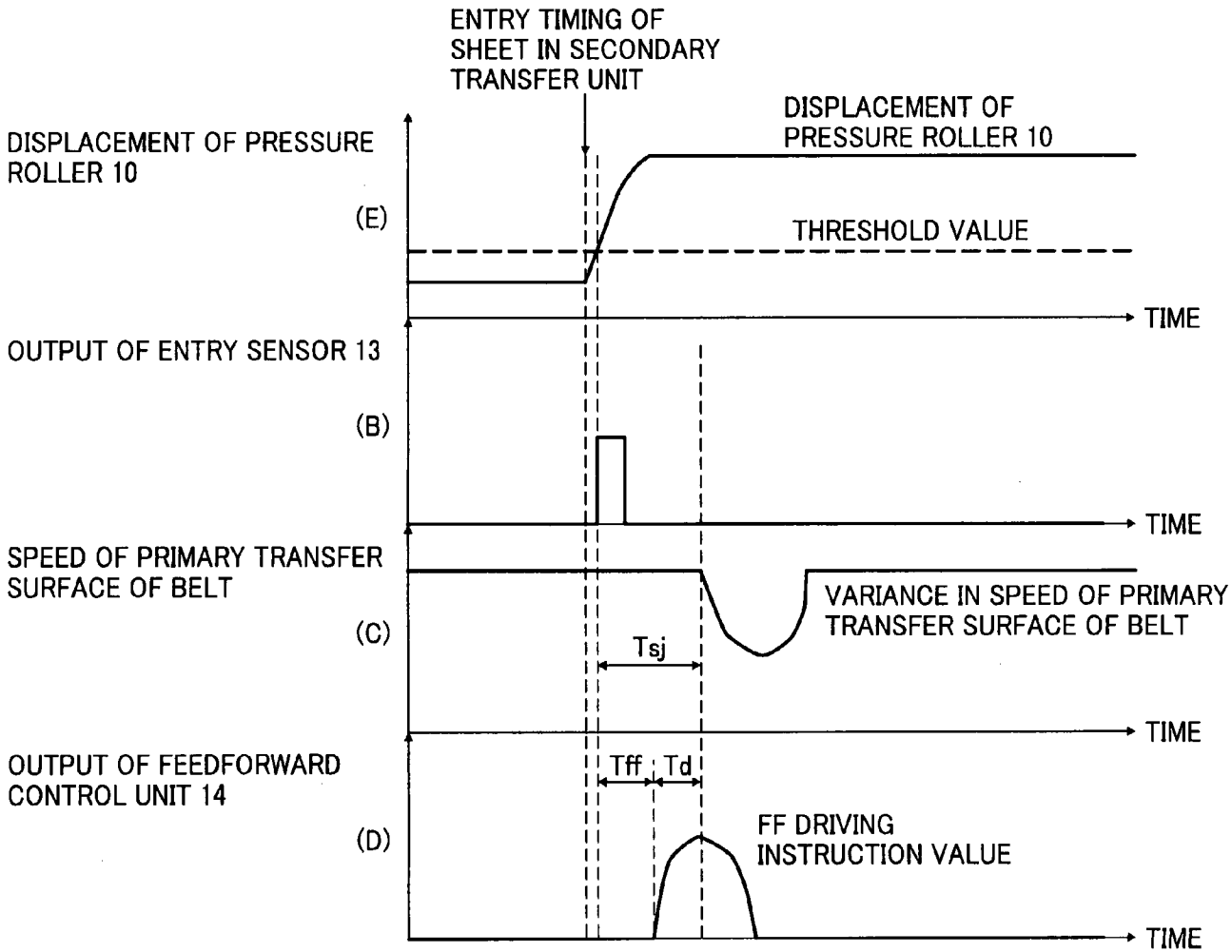
FIG. 15 is a schematic diagram for explaining the operations in the feedforward control performed according to the second embodiment.

According to the second embodiment, a threshold value for the amount of displacement of the pressure roller 10 is stored in advance in the memory unit 131 of the entry sensor 13. The computing unit 130 then compares the displacement information obtained from the displacement information obtaining unit 17 with the threshold value to detect the entry of the sheet 11 in the secondary transfer nip. In FIG. 15, (E) indicates the displacement of the pressure roller 10 in comparison with the threshold value. The computing unit 130 outputs an entry detection signal at the timing when the amount of displacement exceeds the threshold value. Subsequently, the feedforward control is performed in an identical manner as described in the first embodiment. Hence, that description is not repeated.

Given below is the detailed description of the intermediate transfer device according to a third embodiment of the present invention.

According to the third embodiment, information on the conveyance speed (conveyance speed information) of the sheet 11 is obtained and used in detecting its entry in the secondary transfer nip. The detection result is considered as a trigger for performing the feedforward control.

Figure 16:
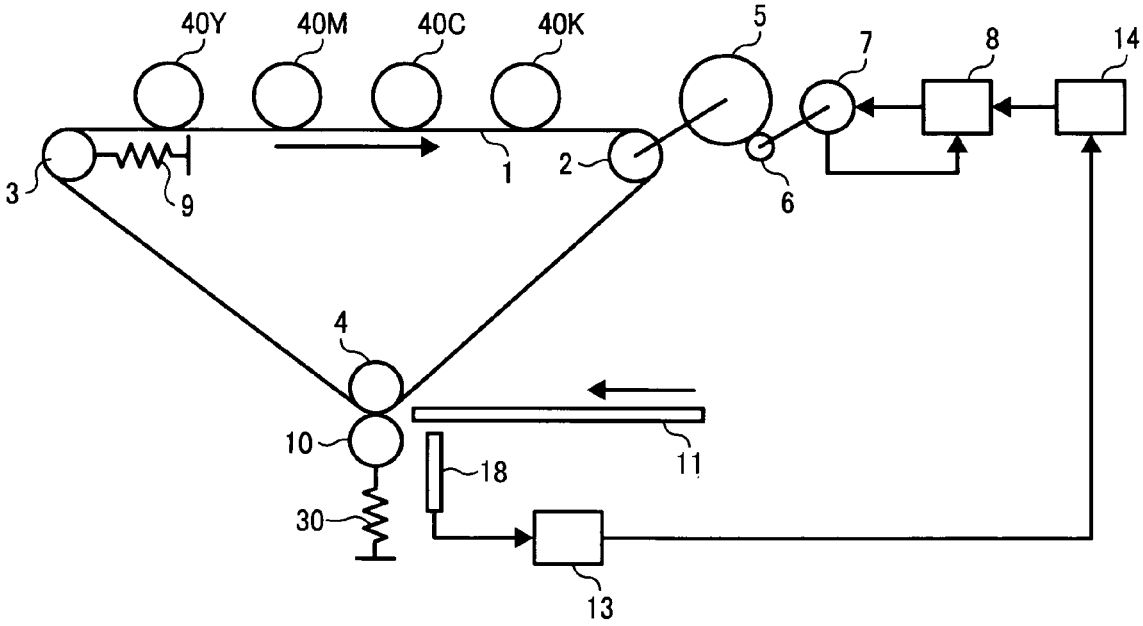
FIG. 16 is a schematic diagram of an exemplary configuration of the intermediate transfer device according to a third embodiment of the present invention.

FIG. 16 is a schematic diagram of an exemplary configuration of the intermediate transfer device according to the third embodiment. As shown in FIG. 16, a conveyance-speed information obtaining unit 18 is disposed to obtain the conveyance speed information of the sheet 11. The conveyance-speed information obtaining unit 18 can be configured to implement, for example, laser Doppler velocimetry technique.

To allow the sheet 11 to enter in the secondary transfer nip, the pressure roller 10 needs to move against the bias of the elastic member 30 by a distance corresponding to about the thickness of the sheet 11. Thus, the sheet 11 inevitably slows down at the moment of entering the secondary transfer nip. The deceleration in the sheet 11 at the moment of entering the secondary transfer nip occurs at the same timing at which speed variance occurs in the supporting roller 4 or in the pressure roller 10. Thus, by using the conveyance speed of the sheet 11 to detect its entry in the secondary transfer nip, it is possible to perform the feedforward control in an identical manner to that described in either of the first two embodiments.

Figure 17:
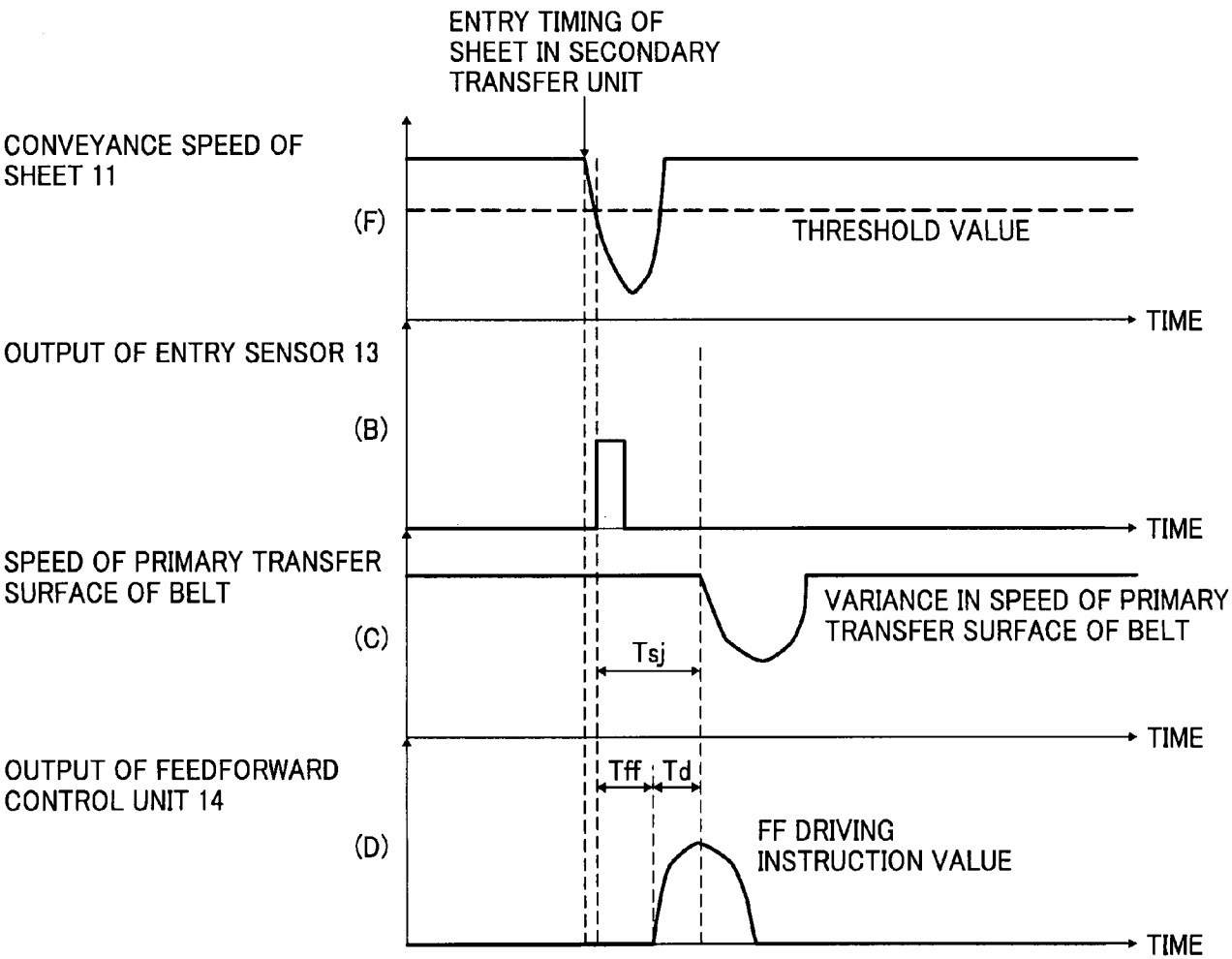
FIG. 17 is a schematic diagram for explaining the operations in the feedforward control performed according to the third embodiment.

According to the third embodiment, a threshold value for the conveyance speed of the sheet 11 is stored in advance in the memory unit 131 of the entry sensor 13. The computing unit 130 then compares the conveyance speed obtained from the conveyance-speed information obtaining unit 18 with the threshold value to detect the entry of the sheet 11 in the secondary transfer nip. In FIG. 17, (F) indicates the conveyance speed of the sheet 11 in comparison with the threshold value. The computing unit 130 outputs an entry detection signal at the timing when the conveyance speed of the sheet 11 drops below the threshold value. Subsequently, the feedforward control is performed in an identical manner as described in the first embodiment. Hence, that description is not repeated.

Given below is the detailed description of the intermediate transfer device according to a fourth embodiment of the present invention.

According to the fourth embodiment, information is obtained regarding the rotation of rollers in a sheet conveying mechanism that conveys the sheet 11 to the secondary transfer nip. That rotation information is used in detecting the entry of the sheet 11 in the secondary transfer nip. The detection result is considered as a trigger for performing the feedforward control.

Figure 18:
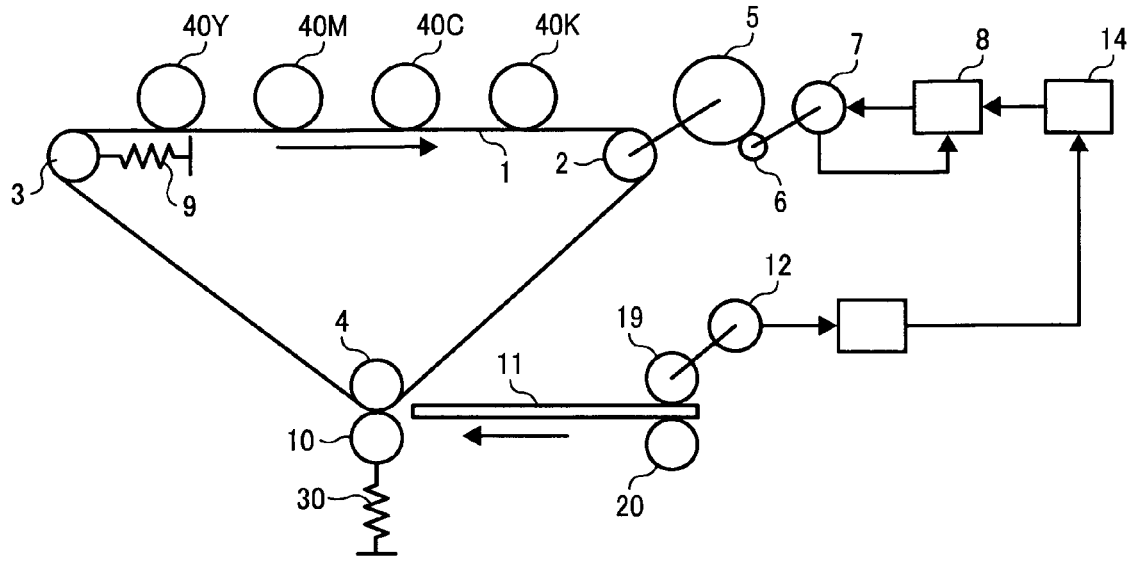
FIGS. 18 and 19 are schematic diagrams of exemplary configurations of the intermediate transfer device according to a fourth embodiment of the present invention.
Figure 19:
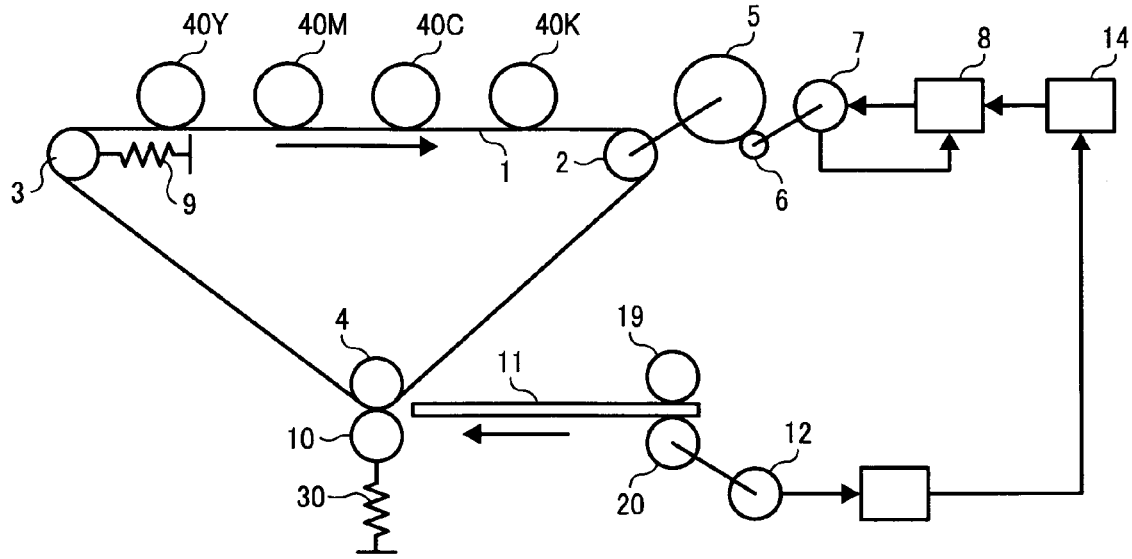

FIGS. 18 and 19 are schematic diagrams of exemplary configurations of the intermediate transfer device according to the fourth embodiment. In the intermediate transfer device shown in FIG. 18 or FIG. 19, a sheet conveying mechanism that includes a pair of a first conveying roller 19 and a second conveying roller 20 is disposed at the upstream side of the secondary transfer nip in the sheet conveying direction at a distance shorter than the length of the sheet conveying direction from the secondary transfer nip.

In the intermediate transfer device shown in FIG. 18, the rotation information obtaining unit 12 obtains the rotation information of the first conveying roller 19; while in the intermediate transfer device shown in FIG. 19, the rotation information obtaining unit 12 obtains the rotation information of the second conveying roller 20. Meanwhile, the rotation information obtaining unit 12 can be, for example, a rotary encoder or a tachometer generator.

As described above in the third embodiment, the sheet 11 inevitably slows down at the moment of entering the secondary transfer nip. If the sheet 11 is stiff in nature (e.g., a sheet of heavy paper), the deceleration thereof at the moment of entering the secondary transfer nip reaches the sheet conveying mechanism and causes variance in the rotating state of the first conveying roller 19 and the second conveying roller 20. If the sheet 11 is substantially stiff, then the variance in the rotating state of the first conveying roller 19 and the second conveying roller 20 occurs at the same timing at which the sheet 11 enters the secondary transfer nip. Thus, by using the rotation information of the first conveying roller 19 or the second conveying roller 20 to detect the entry of the sheet 11 in the secondary transfer nip, it is possible to perform the feedforward control in an identical manner to that described in the first three embodiments.

Figure 20:
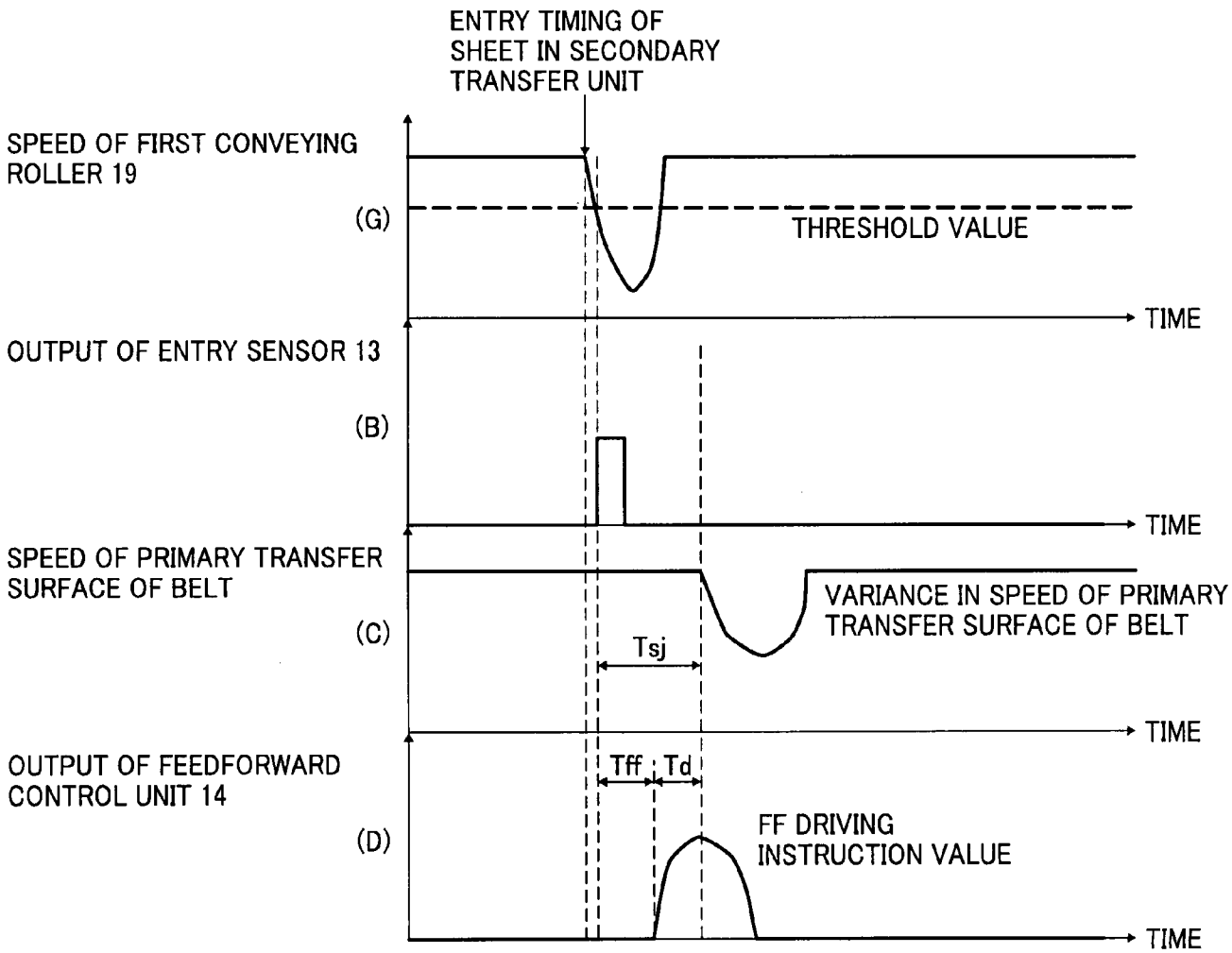
FIG. 20 is a schematic diagram for explaining the operations in the feedforward control performed according to the fourth embodiment.

According to the fifth embodiment, a threshold value for the speed variance in the first conveying roller 19 or the second conveying roller 20 is stored in advance in the memory unit 131 of the entry sensor 13. The computing unit 130 then converts the rotation information of the first conveying roller 19 or the second conveying roller 20 obtained by the rotation information obtaining unit 12 into speed information and compares it with the corresponding threshold value to detect the entry of the sheet 11 in the secondary transfer nip. In FIG. 20, (G) indicates the speed of the first conveying roller 19 in comparison with the corresponding threshold value. The computing unit 130 outputs an entry detection signal at the timing when the speed of the first conveying roller 19 drops below the threshold value. In an identical manner, the entry of the sheet 11 in the secondary transfer nip can also be detected by using speed information of the second conveying roller 20. Subsequently, the feedforward control is performed in an identical manner as described in the first embodiment. Hence, that description is not repeated.

Given below is the detailed description of the intermediate transfer device according to a fifth embodiment of the present invention.

According to the fifth embodiment, the intermediate transfer device includes a transfer and fixing unit that not only secondary-transfers an image from an intermediate transfer belt on a sheet but also fixes the image on the image-recorded sheet in a simultaneous manner.

Figure 21:
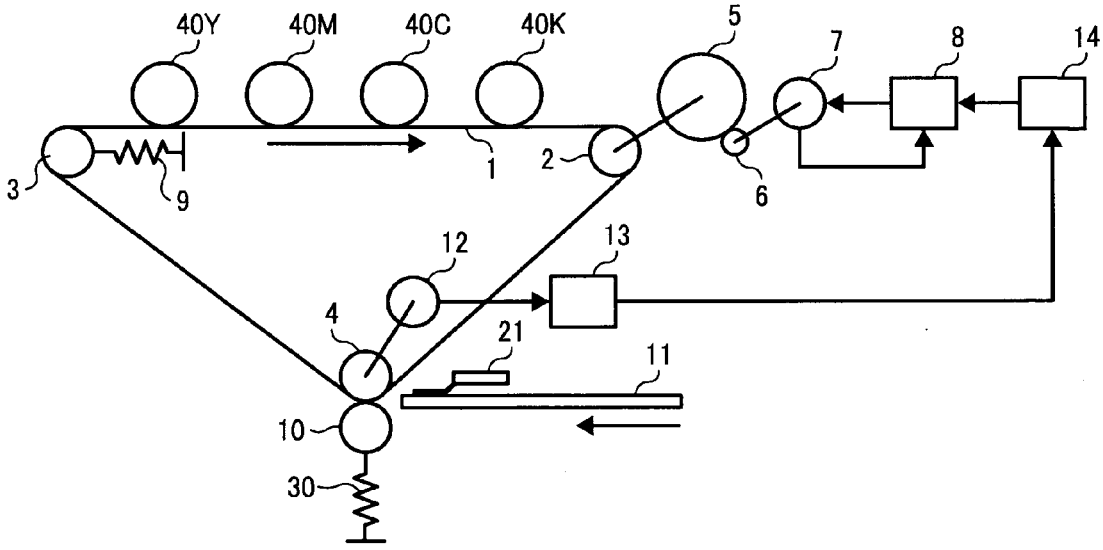
FIGS. 21 and 22 are schematic diagrams of exemplary configurations of the intermediate transfer device according to a fifth embodiment of the present invention.

FIG. 21 is a schematic diagram of an exemplary configuration of the intermediate transfer device including a transfer and fixing unit according to the fifth embodiment. As shown in FIG. 21, the transfer and fixing unit includes the supporting roller 4 and the pressure roller 10 constituting the secondary transfer unit and a heating unit 21 that is disposed close to the secondary transfer unit and at the upstream side of the second transfer unit in the sheet conveying direction. The heating unit 21 heats the sheet 11 to a temperature that is sufficiently high for the toner to get fixed on the image-recorded sheet 11. Thus, the transfer and fixing unit transfers and fixes an image on the sheet 11 in a simultaneous manner.

Figure 22:
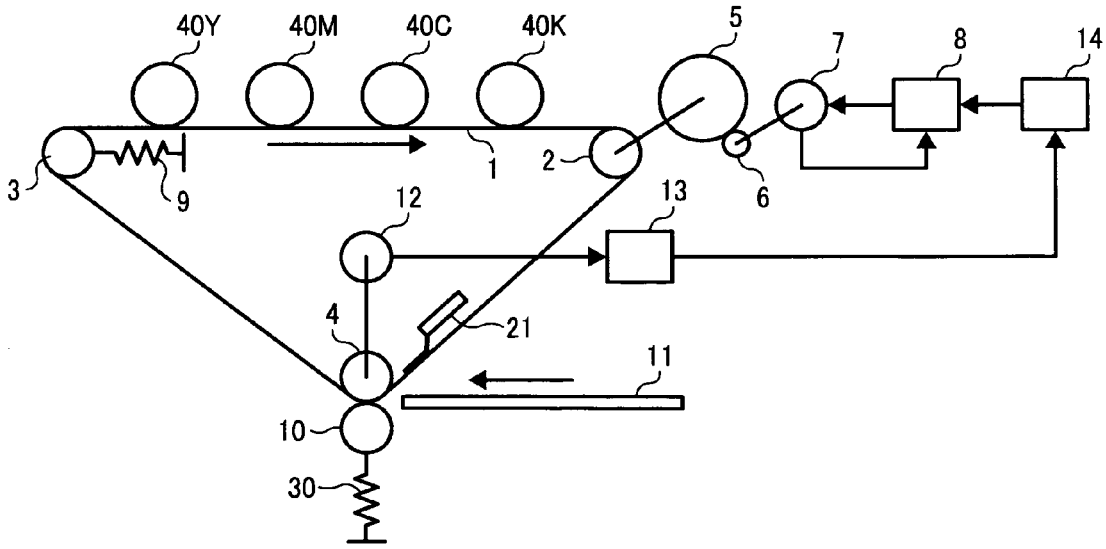
Figure 23:
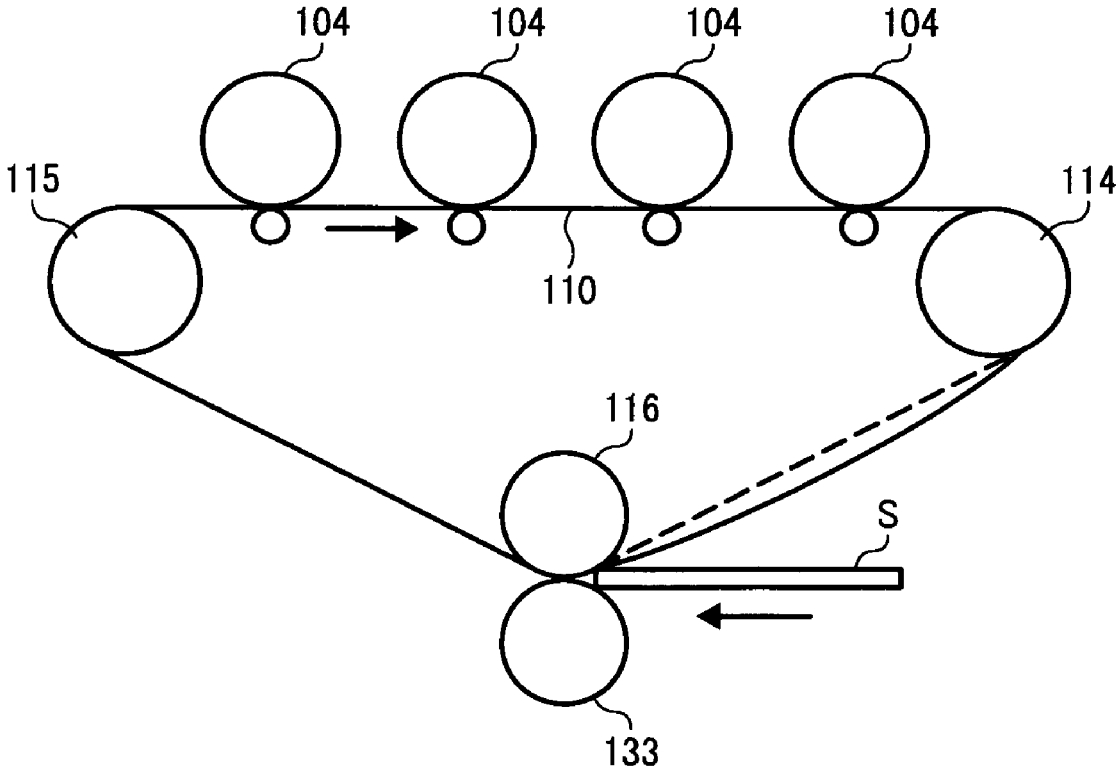
FIG. 23 is a schematic diagram for explaining a change in the stretched state of an intermediate transfer belt caused to an entry of a sheet in a secondary transfer nip.

FIG. 22 is a schematic diagram of another exemplary configuration of the intermediate transfer device including a transfer and fixing unit according to the fifth embodiment. As shown in FIG. 22,.the heating unit 21 is disposed to heat the intermediate transfer belt 1 such that the toner in the toner image formed thereon melts. Subsequently, the molten toner image is secondary-transferred and fixed on the sheet 11 in a simultaneous manner.

Meanwhile, when the sheet 11 enters the secondary transfer nip in the intermediate transfer device that includes a transfer and fixing unit as described above, the supporting roller 4, the pressure roller 10, the intermediate transfer belt 1, the sheet 11, and the sheet conveying mechanism behave in an identical manner as described in the first four embodiments. Thus, it is possible to perform the feedforward control in an identical manner to that described in the first four embodiments. Hence, that description is not repeated.

To sum up, according to an aspect of the embodiments, the intermediate transfer belt 1 in the intermediate transfer device is an image carrying belt that is stretched around a plurality of supporting members in a loop-like manner and that makes an endless movement. The pressure roller 10, which functions as a secondary transfer roller, is disposed opposite to the supporting roller 4, which is one of the supporting members, across the intermediate transfer belt 1. The pressure roller 10 abuts against the outer surface of the intermediate transfer belt 1 to form the secondary transfer nip. The driving source 7 drives the driving roller 2, which is another one of the supporting members. The driving force transmission unit transmits the driving force from the driving source 7 to the driving roller 2. The drive control unit 8 performs drive control of the driving source 7. The feedforward control unit 14 performs feedforward control on the driving source 7 via the drive control unit 8 to reduce speed variance in the endless movement of the intermediate transfer belt 1 caused due to an entry of the sheet 11 in the secondary transfer nip. In the intermediate transfer device, a visible image that has been formed on the surface of each photosensitive drum 40 (photosensitive drums 40Y, 40M, 40C, and 40K), which is a latent-image carrying member, is primary-transferred and superimposed on one another on the outer surface of the intermediate transfer belt 1. The visible image is then secondary-transferred to the sheet 11 that has entered the secondary transfer nip. The intermediate transfer device additionally includes the entry detecting unit 35 that detects the entry of the sheet 11 in the secondary transfer nip and outputs an entry detection signal. The feedforward control unit 14 considers the entry detection signal as a trigger for performing feedforward control after a predetermined time. The speed variance in the movement of the primary transfer surface of the intermediate transfer belt 1 occurs with a certain time difference after the sheet 11 enters the secondary transfer nip. That time difference can be used in detecting the entry of the sheet 11 in the secondary transfer nip and the entry detection signal can be considered as a trigger for performing the feedforward control. Moreover, because the time difference between the entry of the sheet 11 in the secondary transfer nip and the speed variance in the movement of the primary transfer surface of the intermediate transfer belt 1 has a substantially small variability, it is possible to accurately match the timing of the feedforward control with the timing at which speed variance occurs in the movement of the primary transfer surface of the intermediate transfer belt 1. Conventionally, because the timing of the entry of a sheet in a secondary transfer nip is not detected but estimated, the feedforward control has a variable effect. In comparison, in the abovementioned embodiments, the feedforward control is performed after detecting the entry of the sheet 11 in the secondary transfer nip. As a result, there is less variability in the effect of the feedforward control. That enables a stable feedforward control on a consistent basis.

Moreover, according to another aspect of the embodiments, the entry detecting unit 35 includes the rotation information obtaining unit 12 that obtains the rotation information of the supporting roller 4 and the entry sensor 13 that detects an entry of the sheet 11 in the secondary transfer nip by using the rotation information obtained by the rotation information obtaining unit 12 and outputs an entry detection signal. The entry of the sheet 11 in the secondary transfer nip causes variance in the rotating state of the supporting roller 4. Thus, by using the rotation information obtaining unit 12 to detect that variance, it becomes possible to detect that the sheet 11 has entered the secondary transfer nip.

Furthermore, according to still another aspect of the embodiments, the entry detecting unit 35 includes the rotation information obtaining unit 12 that obtains the rotation information of the pressure roller 10 and the entry sensor 13 that detects an entry of the sheet 11 in the secondary transfer nip by using the rotation information obtained by the rotation information obtaining unit 12 and outputs an entry detection signal. The entry of the sheet 11 in the secondary transfer nip causes variance in the rotating state of the pressure roller 10, which forms the secondary transfer nip with the supporting roller 4. Thus, by using the rotation information obtaining unit 12 to detect that variance, it becomes possible to detect that the sheet 11 has entered the secondary transfer nip.

Moreover, according to still another aspect of the embodiments, the pressure roller 10 is disposed in a displaceable manner with respect to the entry of the sheet 11 in the secondary transfer nip. The entry detecting unit 35 includes the displacement information obtaining unit 17 that measures the amount of displacement of the transfer roller 10 and the entry sensor 13 that detects an entry of the sheet 11 in the secondary transfer nip by using the amount of displacement measured by the displacement information obtaining unit 17 and outputs an entry detection signal. The entry of the sheet 11 in the secondary transfer nip causes displacement of the pressure roller 10 by a distance corresponding to about the thickness of the sheet 11. Thus, by using the displacement information obtaining unit 17 to detect that amount of displacement, it becomes possible to detect that the sheet 11 has entered the secondary transfer nip.

Furthermore, according to still another aspect of the embodiments, the entry detecting unit 35 includes the conveyance-speed information obtaining unit 18 that measures the conveyance speed of the intermediate transfer belt 1 and the entry sensor 13 that detects an entry of the sheet 11 in the secondary transfer nip by using the conveyance speed measured by the conveyance-speed information obtaining unit 18 and outputs an entry detection signal. The conveyance speed of the sheet 11 decreases at the moment when the sheet 11 enters the secondary transfer nip. Thus, by using the conveyance-speed information obtaining unit 18 to detect that decrease in the conveyance speed, it becomes possible to detect that the sheet 11 has entered the secondary transfer nip.

Moreover, according to still another aspect of the embodiments, the intermediate transfer device includes the pair of the first conveying roller 19 and the second conveying roller 20 that constitutes the sheet conveying mechanism and sandwichedly conveys the sheet 11 to the secondary transfer nip. The entry detecting unit 35 includes the rotation information obtaining unit 12 that obtains the rotation information of either one of the first conveying roller 19 and the second conveying roller 20 and the entry sensor 13 that detects an entry of the sheet 11 in the secondary transfer nip by using the rotation information obtained by the rotation information obtaining unit 12 and outputs an entry detection signal. If the sheet 11 is stiff in nature, the deceleration thereof at the moment of entering the secondary transfer nip reaches the sheet conveying mechanism and causes variance in the rotating state of the first conveying roller 19 and the second conveying roller 20. Thus, by using the rotation information obtaining unit 12 to detect that variance, it becomes possible to detect that the sheet 11 has entered the secondary transfer nip.

Furthermore, according to still another aspect of the embodiments, the visible image carried by the intermediate transfer belt 1 is a toner image. The intermediate transfer device additionally includes the heating unit 21 that is disposed close to the secondary transfer nip and that heats either one of the intermediate transfer belt 1 and the sheet 11. Such a configuration enables the intermediate transfer device to transfer the toner image from the intermediate transfer belt 1 on the sheet 11 at the secondary transfer nip and simultaneously fix the toner image on the image-recorded sheet 11. Even in such a configuration, it is possible to perform the feedforward control and obtain the abovementioned advantages.

Moreover, according to still another aspect of the embodiments, in an image forming apparatus that includes the photosensitive drums 40 (photosensitive drums 40Y, 40M, 40C, and 40K), the developing unit that develops the latent image carried by the corresponding photosensitive drum 40 into a visible image, and the transfer device that transfers the visible image on the sheet 11, if the intermediate transfer device according to the abovementioned embodiments is employed as the transfer device, then it is possible to achieve a stable feedforward control on a consistent basis and prevent an image from getting distorted in the primary transfer unit.

Meanwhile, although the image forming apparatus described above is assumed to be a color tandem-type image forming apparatus in which the photosensitive drums 40 are disposed corresponding to each color, the present invention is also applicable to a color single-drum image forming apparatus or a monochrome image forming apparatus. In that case, only a single photosensitive drum 40 is disposed.

In this way, according to an aspect of the present invention, it is possible to accurately match the timing of a feedforward control with the timing at which speed variance occurs in the movement of an image carrying belt.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A transfer device comprising:

a plurality of supporting members;

an image carrying belt that is stretched around the supporting members in a loop-like manner and that makes an endless movement;

a transfer roller that is disposed opposite to one of the supporting members across the image carrying belt and that abuts against an outer surface of the image carrying belt to form a transfer nip;

a driving source that drives a driving roller that is one of the supporting members other than the one of the supporting members opposite to the transfer roller across the image carrying belt;

a driving force transmission unit that transmits a driving force from the driving source to the driving roller;

a drive control unit that performs drive control of the driving source;

a feedforward control unit that performs a feedforward control on the driving source via the drive control unit to reduce speed variance in the endless movement of the image carrying belt caused due to an entry of a sheet in the transfer nip; and an entry detecting unit that detects an entry of a sheet in the transfer nip and outputs an entry detection signal, wherein the transfer device transfers a visible image that has been formed on a surface of a latent-image carrying member on the outer surface of the image carrying belt and then transfers the visible image that has been transferred on the outer surface of the image carrying member on the sheet that has entered the transfer nip, and the feedforward control unit considers the entry detection signal output by the entry sensor as a trigger for performing feedforward control after a predetermined time, and wherein the one of the supporting members opposite to the transfer roller across the image carrying belt is a supporting roller, and the entry detecting unit includes a rotation information obtaining unit that obtains rotation information regarding a rotating state of the supporting roller, the rotating state undergoing variance by an entry of a sheet in the transfer nip; and an entry sensor that detects the entry of the sheet in the transfer nip by using the rotation information obtained by the rotation information obtaining unit and outputs an entry detection signal.

2. The transfer device according to claim 1, wherein the entry detecting unit includes a rotation information obtaining unit that obtains rotation information regarding a rotating state of the transfer roller, the rotating state undergoing variance by an entry of a sheet in the transfer nip; and an entry sensor that detects the entry of the sheet in the transfer nip by using the rotation information obtained by the rotation information obtaining unit and outputs an entry detection signal.

3. The transfer device according to claim 1, wherein the transfer roller is disposed in a displaceable manner and is displaced by an entry of a sheet in the transfer nip, and the entry detecting unit includes a displacement information obtaining unit that measures an amount of displacement of the transfer roller; and an entry sensor that detects the entry of the sheet in the transfer nip by using the amount of displacement measured by the displacement information obtaining unit and outputs an entry detection signal.

4. The transfer device according to claim 1, wherein the entry detecting unit includes a conveyance-speed information obtaining unit that measures conveyance speed of a sheet being conveyed to the transfer nip, the conveyance speed undergoing variance when the sheet enters the transfer nip; and an entry sensor that detects the entry of the sheet in the transfer nip by using the conveyance speed measured by the conveyance-speed information obtaining unit and outputs an entry detection signal.

5. The transfer device according to claim 1, further comprising a sheet conveying mechanism that includes a pair of rollers of a first conveying roller and a second conveying roller that sandwichedly conveys a sheet to the transfer nip, wherein the entry detecting unit includes a rotation information obtaining unit that obtains rotation information regarding a rotating state of either one of the first conveying roller and the second conveying roller, the rotating state undergoing variance by an entry of a sheet in the transfer nip; and an entry sensor that detects the entry of the sheet in the transfer nip by using the rotation information obtained by the rotation information obtaining unit and outputs an entry detection signal.

6. The transfer device according to claim 1, wherein the visible image transferred on the outer surface of the image carrying belt is a toner image, the transfer device further comprises a heating unit that is disposed close to the transfer nip and that heats either one of the image carrying belt and a sheet that has entered the transfer nip, and the transfer device transfers the toner image from the image carrying belt on the sheet that has entered the transfer nip and simultaneously fixes the toner image on the sheet.

7. An image forming apparatus comprising:

a latent-image carrying member that carries a latent image;

a developing unit that develops the latent image carried by the latent-image carrying member into a visible image; and a transfer device that transfers the visible image developed on the latent-image carrying member on a sheet, wherein the transfer device includes a plurality of supporting members, an image carrying belt that is stretched around the supporting members in a loop-like manner and that makes an endless movement, a transfer roller that is disposed opposite to one of the supporting members across the image carrying belt and that abuts against an outer surface of the image carrying belt to form a transfer nip, a driving source that drives a driving roller that is one of the supporting members other than the one of the supporting members opposite to the transfer roller across the image carrying belt, a driving force transmission unit that transmits a driving force from the driving source to the driving roller, a drive control unit that performs drive control of the driving source, a feedforward control unit that performs a feedforward control on the driving source via the drive control unit to reduce speed variance in the endless movement of the image carrying belt caused due to an entry of a sheet in the transfer nip, and an entry detecting unit that detects an entry of a sheet in the transfer nip and outputs an entry detection signal, the transfer device transfers the visible image on the outer surface of the image carrying belt and then transfers the visible image that has been transferred on the outer surface of the image carrying member on the sheet that has entered the transfer nip, and the feedforward control unit considers the entry detection signal output by the entry sensor as a trigger for performing feedforward control after a predetermined time, and wherein the one of the supporting members opposite to the transfer roller across the image carrying belt is a supporting roller, and the entry detecting unit includes a rotation information obtaining unit that obtains rotation information regarding a rotating state of the supporting roller, the rotating state undergoing variance by an entry of a sheet in the transfer nip; and an entry sensor that detects the entry of the sheet in the transfer nip by using the rotation information obtained by the rotation information obtaining unit and outputs an entry detection signal.

* * * * *